US007324893B2

(12) United States Patent
Yamashita et al.

(10) Patent No.: US 7,324,893 B2
(45) Date of Patent: Jan. 29, 2008

(54) TRAFFIC MANAGEMENT SYSTEM

(75) Inventors: Kiyohide Yamashita, Yokohama (JP); Yuji Nagano, Yokohama (JP); Yuji Nomura, Yokohama (JP); Hiroshi Ogura, Kawasaki (JP); Kazuyoshi Nagai, Kawasaki (JP); Takato Ohashi, Yokohama (JP); Kanna Okamura, Yokohama (JP)

(73) Assignee: Fujitsu Limited, Kawasaki (JP)

( * ) Notice: Subject to any disclaimer, the term of this patent is extended or adjusted under 35 U.S.C. 154(b) by 26 days.

(21) Appl. No.: 10/931,777

(22) Filed: Sep. 1, 2004

(65) Prior Publication Data

US 2005/0209769 A1 Sep. 22, 2005

(30) Foreign Application Priority Data

Mar. 22, 2004 (JP) ..... 2004-082221

(51) Int. Cl.
*G08G 1/00* (2006.01)

(52) U.S. Cl. ..... 701/117; 340/903

(58) Field of Classification Search ..... 701/117, 701/119, 207, 208, 209, 210, 118; 340/903, 340/905, 991, 993, 992, 990, 995, 901, 902, 340/904, 907

See application file for complete search history.

(56) References Cited

U.S. PATENT DOCUMENTS

| | | | | |
|---|---|---|---|---|
| 5,987,374 | A * | 11/1999 | Akutsu et al. | 701/117 |
| 6,097,313 | A * | 8/2000 | Takahashi et al. | 340/905 |
| 6,151,550 | A * | 11/2000 | Nakatani | 701/117 |
| 6,396,418 | B2 * | 5/2002 | Naito | 340/928 |
| 6,690,293 | B2 * | 2/2004 | Amita | 340/928 |
| 6,804,602 | B2 * | 10/2004 | Impson et al. | 701/117 |
| 6,985,089 | B2 * | 1/2006 | Liu et al. | 340/903 |
| 7,145,475 | B2 * | 12/2006 | Kavner | 340/933 |

FOREIGN PATENT DOCUMENTS

| | | |
|---|---|---|
| JP | 10-307993 | 11/1998 |
| JP | 2002-150471 | 5/2002 |
| JP | 2002-208080 | 7/2002 |
| JP | 2002-271829 | 9/2002 |
| JP | 2002-298286 | 10/2002 |

* cited by examiner

*Primary Examiner*—Dalena Tran
(74) *Attorney, Agent, or Firm*—Katten Muchin Rosenman LLP

(57) ABSTRACT

A traffic management system manages, distributes, and controls various traveling states of vehicles at a high quality level. A vehicle-mounted unit performs an interconnection process for user authentication when entering a predetermined radio-wave zone. A radio unit disposed on a road sends interconnection process completion information to a center device when the interconnection process for connection to the vehicle is completed. If the vehicle does not connect to the radio unit after elapsed of a predicted time at which the vehicle is expected to travel across the radio unit, then the radio unit sends an overtime to the center device. The interconnection process completion information is received, the center device calculates a predicted time at which the vehicle is expected to pass across a radio unit, and sends the predicted time to the radio unit. When the overtime is received, the center device determines whether a fault has occurred or not. When it is judged that the fault has occurred, the center device sends alarm information to vehicles traveling near a site where the fault has occurred on the vehicle.

11 Claims, 29 Drawing Sheets

T1 FAULT CONTENT RISK LEVEL DETERMINATION TABLE

LEVEL 1: PARKED ON ROAD SIDE

LEVEL 2: BLOCKING ONE LANE

LEVEL 3: BLOCKING ALL LANES

T2 OVERTIME RISK LEVEL DETERMINATION TABLE

LEVEL 1: WITHIN 1 MIN.

LEVEL 2: WITHIN 5 MIN.

LEVEL 3: MORE THAN 5 MIN.

T3 NOTIFICATION RATIO TABLE

LEVEL 1: 10%

LEVEL 2: 50%

LEVEL 3: 100%

FIG. 21

T4 DISTANCE-DEPENDENT NOTIFICATION RATIO DETERMINATION TABLE

| |
|---|
| 1 km: 100% |
| 5 km: 50% |
| MORE THAN 5 km: 10% |

T5 INTER-RADIO UNIT DISTANCE INFORMATION TABLE

| |
|---|
| BETWEEN RADIO UNITS 20-4, 20-3: 1 km |
| BETWEEN RADIO UNITS 20-3, 20-2: 3 km |
| BETWEEN RADIO UNITS 20-2, 20-1: 4 km |
| ⋮ |

FIG. 24

TRAFFIC MANAGEMENT SYSTEM

CROSS-REFERENCE TO RELATED APPLICATIONS

This application is based upon and claims the benefits of priority from the prior Japanese Application No. 2004-082221, filed on Mar. 22, 2004, the entire contents of which are incorporated herein by reference.

BACKGROUND OF THE INVENTION (1) Field of the Invention

The present invention relates to a traffic management system, and more particularly to a traffic management system for managing vehicle traffic.

(2) Description of the Related Art

In recent years, attention has been attracted to 5.8 GHz short-range radio communications (DSRC: Dedicated Short-Range Communications) typified by an ETC (Electronic Toll Collection) system which automatically collects tolls from moving vehicles without the need for the vehicles to stop at expressway toll booths. The development of a system of sophisticated networks of roads and vehicles using such short-range radio communications is now in progress.

FIG. 29 of the accompanying drawings shows a conventional road-to-vehicle short-range radio communication system. As shown in FIG. 29, the conventional road-to-vehicle short-range radio communication system has monitor cameras 201, 202 and infrared sensors 211, 212 disposed along a road, a base station 220 disposed near the road, and an information center 230 for managing the entire system.

The information center 230 collects traffic jam information and faulty car information from the monitor cameras 201, 202 and the infrared sensors 211, 212, and analyzes the collected information. The information center 230 sends analytic results to the base station 220, which sends traffic information to those vehicles which are present in its own communication area.

Another conventional short-range radio communication system which has been proposed includes a mobile station, a base station for receiving, via radio communications, information that is representative of an ID of the mobile station, a vehicle type, a present vehicle position, a present time, and a present vehicle speed, a fixed station for receiving the information from the base station through a telephone circuit, and a car navigation unit for providing information contents to measure the present position of the mobile station. The information representing the vehicle position, the vehicle type, the present time, etc. is sent to the fixed station to determine traffic information including a traffic density and a traffic jam. For details, see Japanese laid-open patent publication No. 10-307993, paragraphs 0006 through 0017, FIG. 1, for example.

According to the conventional system shown in FIG. 29, many devices for collecting information, such as monitor cameras for monitoring the road and infrared sensors for monitoring the traffic need to be installed along the road in order to monitor/manage the vehicle traffic situation. Therefore, the entire system is large in scale, a long period of time is required for installing the devices in place, and adjusting the devices after being installed is time-consuming.

The other conventional system disclosed in Japanese laid-open patent publication No. 10-307993 is smaller in scale than the system shown in FIG. 29 because the vehicle as the mobile station and the fixed station communicate with each other to obtain traffic information. However, inasmuch as the vehicle information including the vehicle position and the time information is transmitted from the vehicle to the fixed station, the vehicle has to be equipped with a device of high functionality, such as a car navigation unit for measuring the vehicle position based on GPS, which poses a financial burden on the user of the vehicle. Another problem is that the system does not perform sophisticated traffic management control for predicting the position of a traffic accident and a faulty vehicle and notifying nearby vehicles of the accident information.

SUMMARY OF THE INVENTION

It is therefore an object of the present invention to provide a traffic management system for performing high-quality management control over various vehicle traffic situations.

According to the present invention, there is provided a traffic management system for managing vehicle traffic, comprising a vehicle-mounted unit having a vehicle-mounted communication unit having a function to communicate with a center device, for performing an interconnection process for user authentication when entering a predetermined radio-wave zone, using an individual vehicle ID assigned to each vehicle, and sending fault information in the event of a fault occurring on the vehicle, a radio unit disposed on a road and having a radio communication unit having a function to provide the radio-wave zone for the vehicle and to relay communications between the center device and the vehicle-mounted unit, for sending interconnection process completion information to the center device when the interconnection process for connection to the vehicle is completed, receiving a predicted time at which the vehicle is expected to travel across the radio unit, and sending an overtime to the center device if the vehicle does not connect to the radio unit after elapse of the predicted time, and a center device having a traffic information manager for, when the interconnection process completion information is received, calculating the speed of the vehicle from an inter-radio unit distance and an interconnection time at which the vehicle connects to the radio unit, calculating a predicted time at which the vehicle is expected to pass across a next radio unit from the speed of the vehicle and the distance up to the next radio unit, and sending the predicted time to the radio unit, for, when the fault information is received, sending traffic information including alarm information through the radio unit to vehicles traveling near a site where the fault has occurred on the vehicle, for, when the overtime is received, determining whether the fault has occurred or not, and for, when it is judged that the fault has occurred, sending traffic information including alarm information through the radio unit to vehicles traveling near a site where the fault has occurred on the vehicle.

The above and other objects, features, and advantages of the present invention will become apparent from the following description when taken in conjunction with the accompanying drawings which illustrate a preferred embodiment of the present invention by way of example.

BRIEF DESCRIPTION OF THE DRAWINGS

FIG. 21 is a diagram showing a fault content risk level determination table, an overtime risk level determination table, and a notification ratio table;

FIG. 24 is a diagram showing a distance-dependent notification ratio determination table and an inter-radio unit distance information table;

DESCRIPTION OF THE PREFERRED EMBODIMENT

Figure 1:
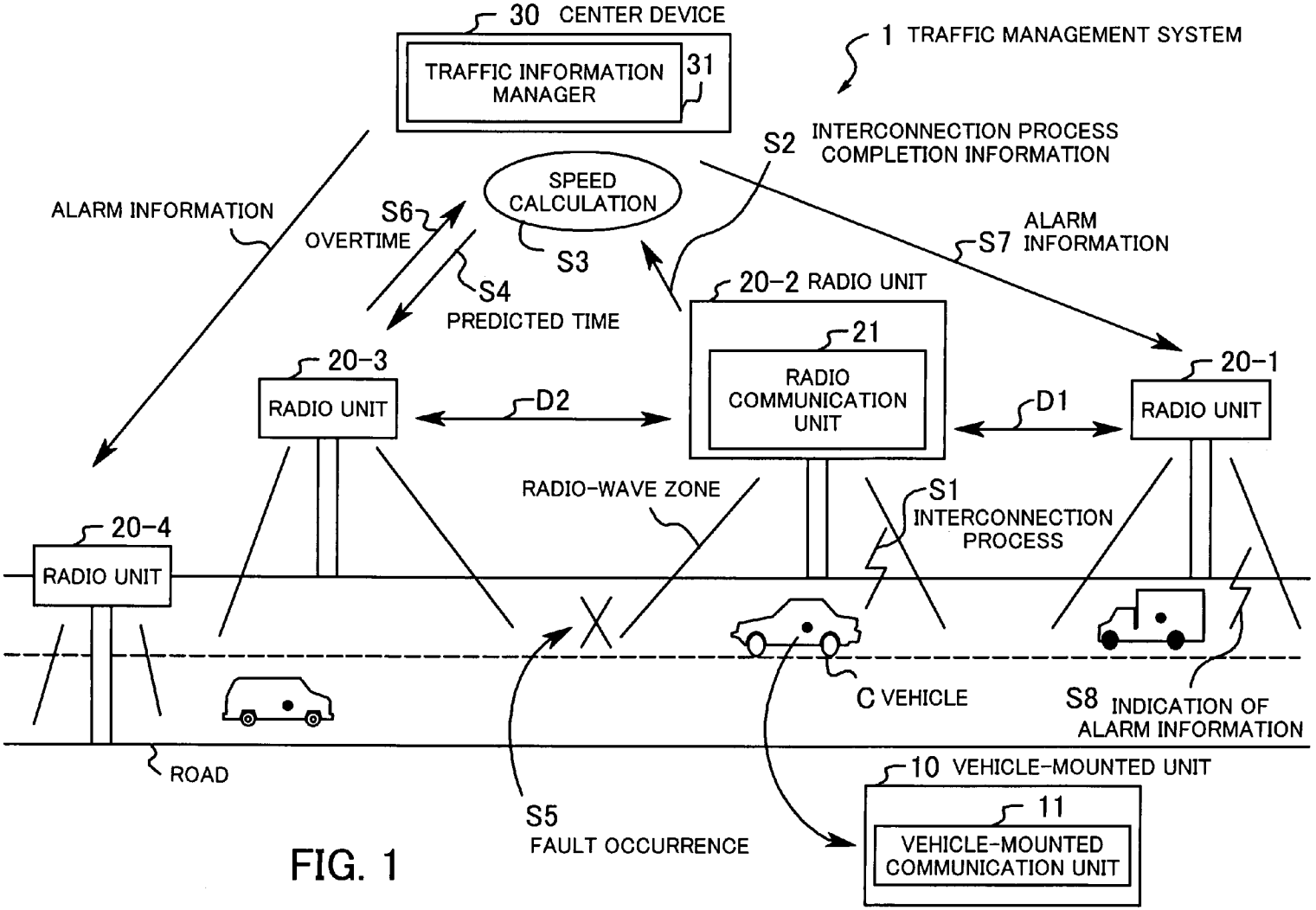
FIG. 1 is a diagram, partly in block form, showing the principles of a traffic management system according to the present invention.

FIG. 1 shows the principles of a traffic management system 1 according to the present invention. As shown in FIG. 1, the traffic management system 1 comprises a vehicle-mounted unit 10, a plurality of radio units 20-1 through 20-4 (collectively referred to as "radio unit 20"), and a center device 30. The traffic management system 1 serves to manage the traffic situation of a vehicle C.

The vehicle-mounted unit 10, which is mounted on the vehicle C, has a vehicle-mounted communication unit 11 for communicating with the center device 30 via the radio unit 20. The vehicle-mounted communication unit 11 performs an interconnection process (i.e., a user authentication process) when entering a radio-wave zone (communication area) provided by the radio unit 20, using an individual vehicle ID assigned to the vehicle C. Alternatively, the vehicle-mounted communication unit 11 may send the vehicle ID via the radio unit 20 to the center device 30 for the center device 30 to perform the user authentication process. When the vehicle C suffers a fault, the vehicle-mounted communication unit 11 transmit fault information representing the fault. In the present invention, various vehicle trouble situations including accidents, vehicle failures, vehicle stops for some reasons on the road, etc. are generally referred to as faults.

The radio unit 20 has a radio communication unit 21 for performing short-range communications. The radio unit 20 is installed along the road, and provides a radio-wave zone to the vehicle C for performing link communications between the center device 30 and the vehicle-mounted unit 10. The radio communication unit 21 performs an interconnection process for connection to the vehicle C. When the interconnection process is completed, the radio communication unit 21 transmits interconnection process completion information to the center device 30. When the radio communication unit 21 has received a predicted time for the passage of the vehicle C, which is transmitted from the center device 30, if the vehicle C does not connect to the radio unit 20 even after the predicted time has elapsed, then the radio communication unit 21 transmits an overtime to the center device 30.

The center device 30 has a traffic information manager 31 for managing traffic information in its entirety. If the traffic information manager 31 receives interconnection process completion information from the radio unit 20, then the traffic information manager 31 calculates the speed of the vehicle C from the inter-radio unit distance and the interconnection time, calculates the predicted time for the passage of the vehicle C at a next radio unit from the vehicle speed and the distance up to the next radio unit, and notifies the radio unit of the predicted time.

If the traffic information manager 31 receives fault information sent from the vehicle-mounted unit 10, then the traffic information manager 31 notifies the vehicle C passing near a fault occurrence site, of traffic information including alarm information via the radio unit 20. If the traffic information manager 31 receives an overtime sent from the radio unit 20, then the traffic information manager 31 determines whether a fault has occurred or not based on the length of the overtime. If the traffic information manager 31 judges that a fault has occurred, then the traffic information manager 31 notifies the vehicle C passing near a site where a fault is regarded as having occurred, of traffic information including alarm information via the radio unit 20. The traffic information sent from the center device 30 includes parking information indicative of whether there is an empty parking space in a parking area or not, in addition to alarm information for indicating an accident to the driver of the vehicle C.

In the traffic management system 1 shown in FIG. 1, the radio unit 20 is notified of a predicted time, and an overtime from the radio unit 20 is received by the center device 30 for judging the occurrence of a fault. However, the radio unit 20 may not be notified of a predicted time, and if the center device 30 does not recognize the completion of the vehicle interconnection via a next radio unit until a predicted time, then the center device 30 may judge the occurrence of a fault depending on the overtime.

A system operation sequence in which the vehicle C connects to the radio unit 20-2 and thereafter suffers a fault, and nearby vehicles are notified of alarm information will be described below with reference to FIG. 1. In this and subsequent operation sequences, the numbers in brackets represent step numbers.

[S1] While the vehicle C is traveling, the vehicle C enters a radio-wave zone provided by the radio unit 20-2. The radio unit 20-2 and the vehicle-mounted unit 10 perform short-range radio communications with each other to carry out an interconnection process (user authentication process) using the vehicle ID.

[S2] When the interconnection process is completed, the radio unit 20-2 sends interconnection process completion information (specifically, time information representative of the time at which the radio unit 20-2 and the vehicle-mounted unit 10 connect to each other, and the vehicle ID) to the center device 30.

[S3] When the center device 30 receives the interconnection process completion information sent from the radio unit 20-2, the center device 30 calculates the speed of the vehicle C. Specifically, since the center device 30 has already received the interconnection process completion information sent from the radio unit 20-2, the center device 30 can calculate the speed of the vehicle C from the distance D1 between the radio unit 20-1 and the radio unit 20-2, an interconnection time of the radio unit 20-1, and an interconnection time of the radio unit 20-2.

[S4] The center device 30 calculates a predicted time of the passage of the vehicle C at the radio unit 20-3 from the calculated speed of the vehicle C and the distance D2 up to the next radio unit 20-3, and notifies the radio unit 20-3 of the vehicle ID and the predicted time.

[S5] The vehicle C suffers an accident after its interconnection to the radio unit 20-2 is finished, resulting in the occurrence of a fault.

[S6] Since the radio unit 20-3 cannot connect to the vehicle C at the predicted time, the radio unit 20-3 periodically sends an overtime in excess of the predicted time to the center device 30.

[S7] Based on the overtime sent from the radio unit 20-3, the center device 30 regards the vehicle C as having suffered a fault in the zone between the radio units 20-2, 20-3, and sends alarm information to the radio unit 20-1 in order to notify other vehicles that are expected to travel in this zone, of the alarm information.

[S8] Having received the alarm information, the radio unit 20-1 notifies a vehicle following the vehicle C of the alarm information when the vehicle enters the radio-wave zone thereof (if the system according to the present invention is applied to roads other than expressways and vehicles traveling along an opposing traffic lane adjacent to the fault occurrence zone, then the radio unit 20-1 may send the alarm information to a radio unit 20-4 that is installed on the opposing traffic lane). Details of the operation will be described later with reference to the drawings from FIG. 5.

As described above, the traffic management system 1 according to the present invention calculates, from the interconnection completion time of an interconnection sequence which is carried out when a vehicle passes through a radio-wave zone of one of the radio units 20 that are installed between PAs (parking areas) or ICs (interchanges) of an expressway, a time at which the vehicle will pass through a radio-wave zone provided by a next one of the radio units 20. The traffic management system 1 then determines whether the vehicle actually passes through the radio-wave zone provided by the next radio unit 20 at the predicted time or not, thereby determining whether the vehicle has suffered a fault or not. Based on the determined results, the traffic management system 1 manages vehicle traffic information, and distributes alarm information.

Figure 2:
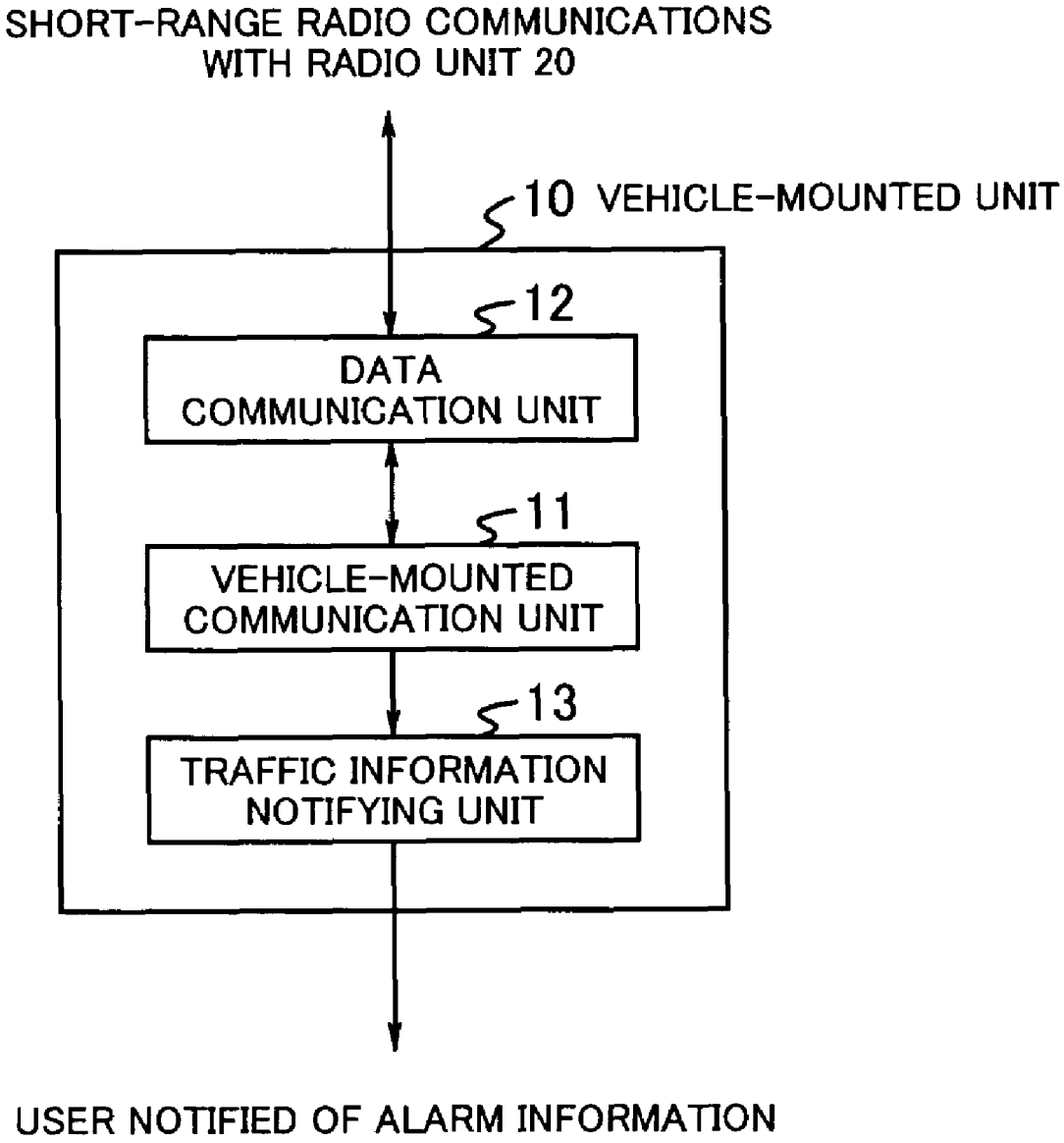
FIG. 2 is a block diagram of a vehicle-mounted unit.

Arrangements of the vehicle-mounted unit 10, the radio unit 20, and the center device 30 will be described in detail below. FIG. 2 shows the vehicle-mounted unit 10 in block form. As shown in FIG. 2, the vehicle-mounted unit 10 comprises a vehicle-mounted communication unit 11, a data communication unit 12, and a traffic information notifying unit 13.

The data communication unit 12 interfaces the radio unit 20 installed on the road for short-range radio data communications. The vehicle-mounted communication unit 11 performs an interconnection process as a user authentication process when entering a radio-wave zone provided by the radio unit 20, using an individual vehicle ID assigned to the vehicle C. When the vehicle C suffers a fault, the vehicle-mounted communication unit 11 sends fault information basically in response to a manual control action made by the driver of the vehicle C.

The traffic information notifying unit 13 notifies the driver of the traffic information that is sent from the center device 30 via the radio unit 20. If the traffic information is alarm information, then the traffic information notifying unit 13 notifies the driver of an sound message "A vehicle accident has occurred ahead . . . ", for example. If the vehicle C is equipped with a car navigation unit, then the traffic information notifying unit 13 may notify the driver of alarm information as an image/sound message from the car navigation unit. On expressways, an expressway radio system may be used to send alarm information to all the vehicles that are present in the frequency reception zone of the expressway radio system.

Figure 3:
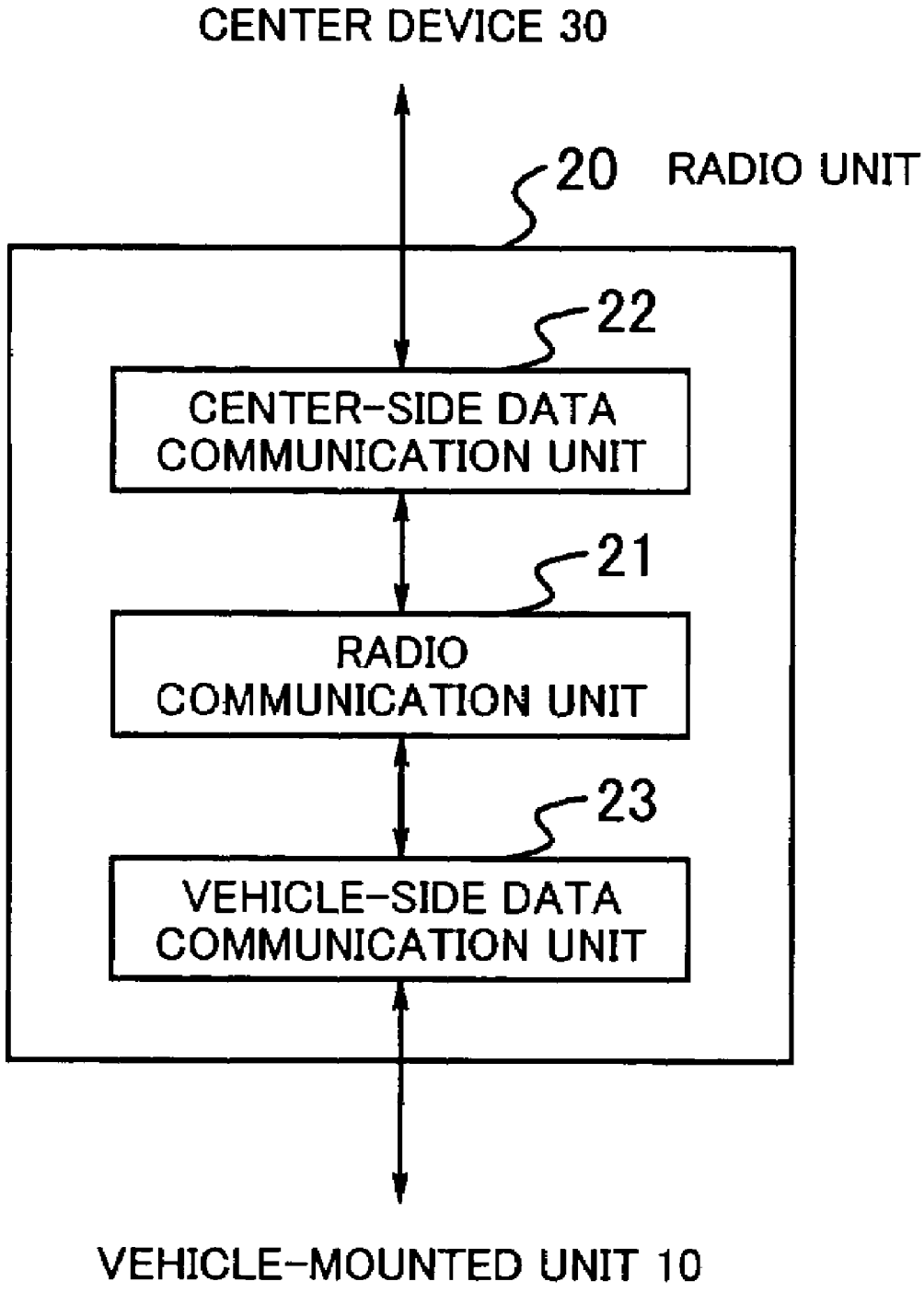
FIG. 3 is a block diagram of a radio unit.

FIG. 3 shows the radio unit 20 in block form. As shown in FIG. 3, the radio unit 20 comprises a radio communication unit 21, a center-side data communication unit 22, and a vehicle-side data communication unit 23. The center-side data communication unit 22 interfaces the center device 30 for data communications. The vehicle-side data communication unit 23 interfaces the vehicle-mounted unit 10 for data communications.

The radio communication unit 21 performs an interconnection process for connection to the vehicle C. When the interconnection process is completed, the radio communication unit 21 transmits interconnection process completion information to the center device 30. The radio communication unit 21 receives a predicted time for the passage of the vehicle C, which is transmitted from the center device 30. If the vehicle C does not connect to the radio unit 20 even after the predicted time has elapsed, then the radio communication unit 21 periodically transmits an overtime to the center device 30.

Figure 4:
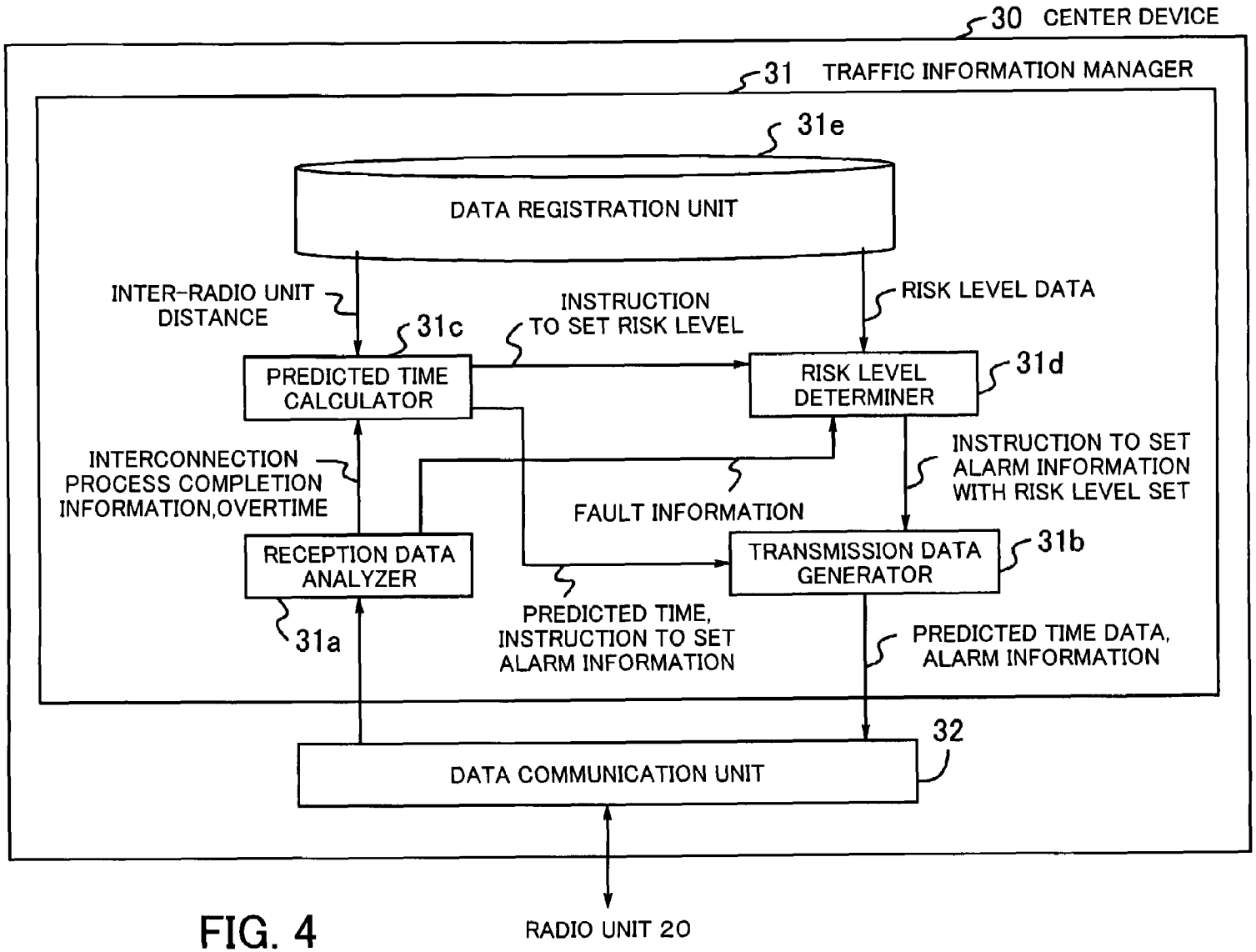
FIG. 4 is a block diagram of a center device.

FIG. 4 shows the center device 30 in block form. As shown in FIG. 4, the center device 30 comprises a traffic information manager 31 and a data communication unit 32. The traffic information manager 31 comprises a reception data analyzer 31*a*, a transmission data generator 31*b*, a predicted time calculator 31*c*, a risk level determiner 31*d*, and a data registration unit 31*e*.

The data communication unit 32 performs data communications with the radio unit 20 installed on the road. The reception data analyzer 31*a* analyzes whether the data sent from the radio unit 20 is interconnection completion process information, fault information, or overtime. If the data sent from the radio unit 20 is interconnection completion process information or overtime, then the reception data analyzer 31*a* sends the interconnection completion process information or the overtime to the predicted time calculator 31*c*. If the data sent from the radio unit 20 is fault information, then the reception data analyzer 31*a* sends the fault information to the risk level determiner 31*d*.

When the predicted time calculator 31*c* receives the interconnection completion process information, it reads the corresponding inter-radio unit distance registered in the data registration unit 31*e*, calculates the speed of the vehicle C from the inter-radio unit distance and the interconnection time, and calculates the predicted time for the passage of the vehicle C at a next radio unit from the vehicle speed and the distance up to the next radio unit. The predicted time calculator 31*c* sends the calculated predicted time to the transmission data generator 31*b*.

When the predicted time calculator 31*c* receives the overtime, it determines whether a fault has occurred or not. If the predicted time calculator 31*c* judges that a fault has occurred, then it gives the transmission data generator 31*b* an alarm information generating instruction to notify the vehicle C passing near a site where the fault is regarded as having occurred, of alarm information via the radio unit 20. If alarm information taking a risk level into account is to be generated, then the predicted time calculator 31*c* gives the risk level determiner 31*d* an instruction to set a risk level.

When the risk level determiner 31*d* receives fault information or an instruction from the predicted time calculator 31*c*, then the risk level determiner 31*d* reads risk level data registered in the data registration unit 31*e*, determines a risk level of the fault information, and sends an alarm information generation instruction based on the determined risk level to the transmission data generator 31*b*. Details of the operation of the risk level determiner 31*d* will be described later with reference to FIGS. 19 through 21.

If the transmission data generator 31*b* receives a predicted time, then it generates a predicted time and sends the generated predicted time to the corresponding radio unit. If the transmission data generator 31*b* receives an alarm information generation instruction, it generates alarm information corresponding to the notification ratio of the risk level (as described later with reference to FIGS. 22 and 23), and sends the generated alarm information to the corresponding radio unit.

Figure 5:
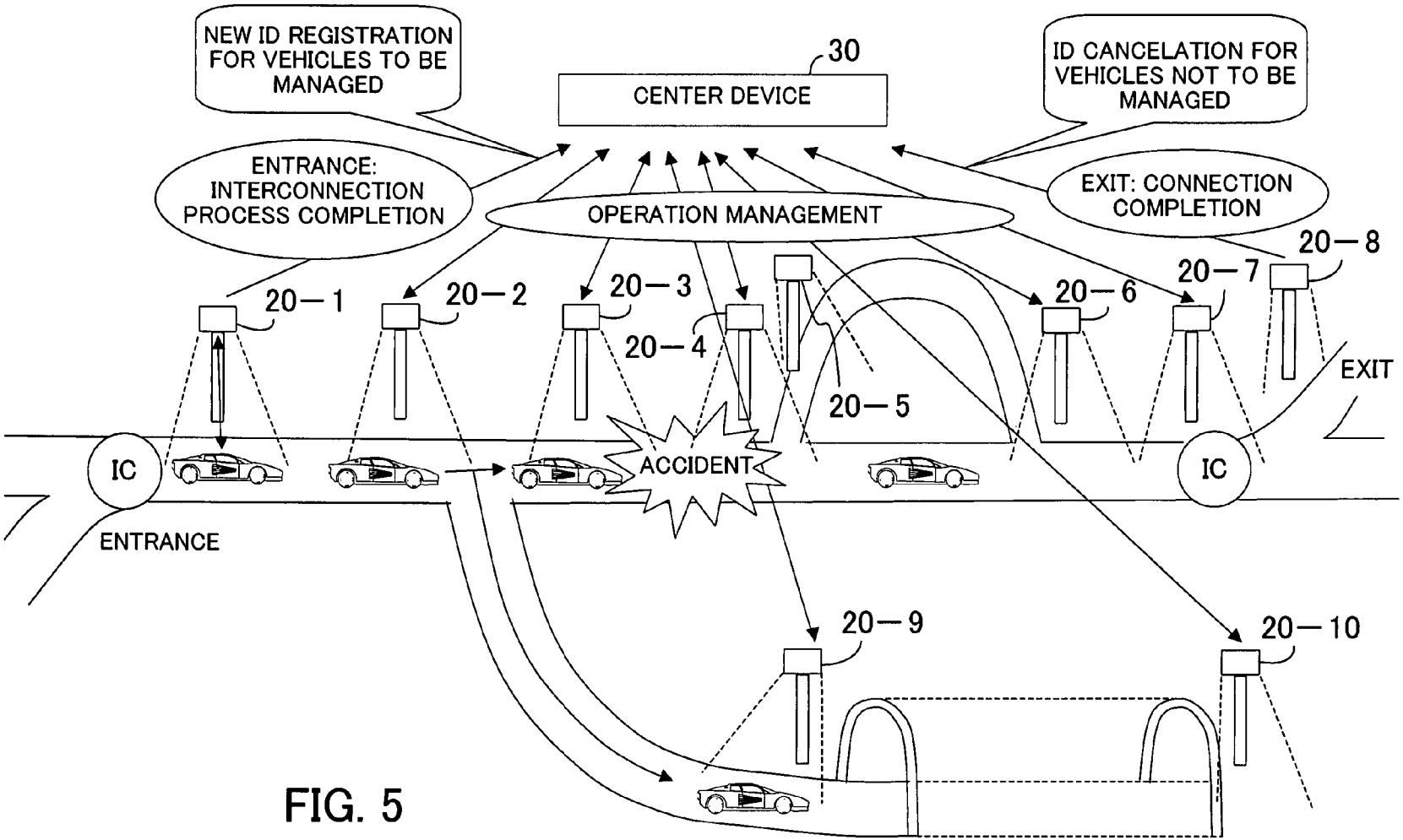
FIG. 5 is a view showing how the traffic management system operates as a whole.

Operation of the traffic management system 1 as it is applied to an expressway will be described below. FIG. 5 shows how the traffic management system 1 operates as a whole. The vehicle C which is equipped with the vehicle-mounted unit 10 communicates with the radio unit 20 when is passes through a radio-wave zone provided by the radio unit 20. The radio unit 20 sends information indicative of the completion of the interconnection process to the center device 30. The center device 30 collects the times at which the vehicle C has passed across the respective locations of the radio units.

The center device 30 has already registered therein the locations of the radio units and the distances between the radio units. The center device 30 calculates the traveling speed of the vehicle C from the times at which the vehicle C has connected to adjacent radio units 20 and the distance between those adjacent radio units 20, and predicts a time at which the vehicle C will reach a next one of the radio units 20 from the calculated traveling speed and the distance up to the next radio unit 20.

For example, when a vehicle C connects to the radio unit 20-1 for the first time and its information is sent to the center device 30, if the vehicle C has a vehicle ID which has not yet been received so far, then the center device 30 newly registers the vehicle ID of the vehicle C, and regards the vehicle C as a vehicle to be managed.

Thereafter, if the center device 30 calculates the average speed of the vehicle C as 60 km/h from the interconnection times at which the vehicle C has connected to the radio units 20-1, 20-2 when traveling between the radio units 20-1, 20-2 and the distance between the radio units 20-1, 20-2, then since the location through which the vehicle C will possibly pass next is the radio unit 20-3 or the radio unit 20-9, the center device 30 predicts times at which the vehicle C will pass across those radio units.

The center device 30 calculates the predicted times from the distances between the radio units which the center device 30 has registered therein. If the distance between the radio units 20-2, 20-3 is 3 km, then it is predicted that the vehicle C will travel between the radio units 20-2, 20-3 in about 3 minutes, and if the distance between the radio units 20-2, 20-9 is 6 km, then it is predicted that the vehicle C will travel between the radio units 20-2, 20-9 in about 6 minutes. Therefore, if the time (interconnection time) at which the vehicle C passes across the radio unit 20-2 is 10:20:30, then the time at which the vehicle C will pass across the radio unit 20-3 is 10:23:30 and the time at which the vehicle C will pass across the radio unit 20-9 is 10:26:30.

After the vehicle C has connected to the radio unit 20-3, if an accident or a vehicle failure occurs in a radio-wave zone provided by the radio unit 20-4 across which the vehicle C is supposed to pass next, or the center device 30 is notified of an accident or a vehicle failure from the vehicle C, then the center device 30 can manage the accident or failure information and can also notify following vehicles of the traffic situation ahead of those vehicles. Since the position of the accident or the faulty vehicle can be detected, it is possible to send a wrecker truck or inspection personnel to the accident or vehicle failure site. When the vehicle C that passed across the radio units connects to the radio unit installed at the exit of the expressway, the vehicle ID of the vehicle C is deleted from the vehicle IDs which are to be managed.

Figure 6:
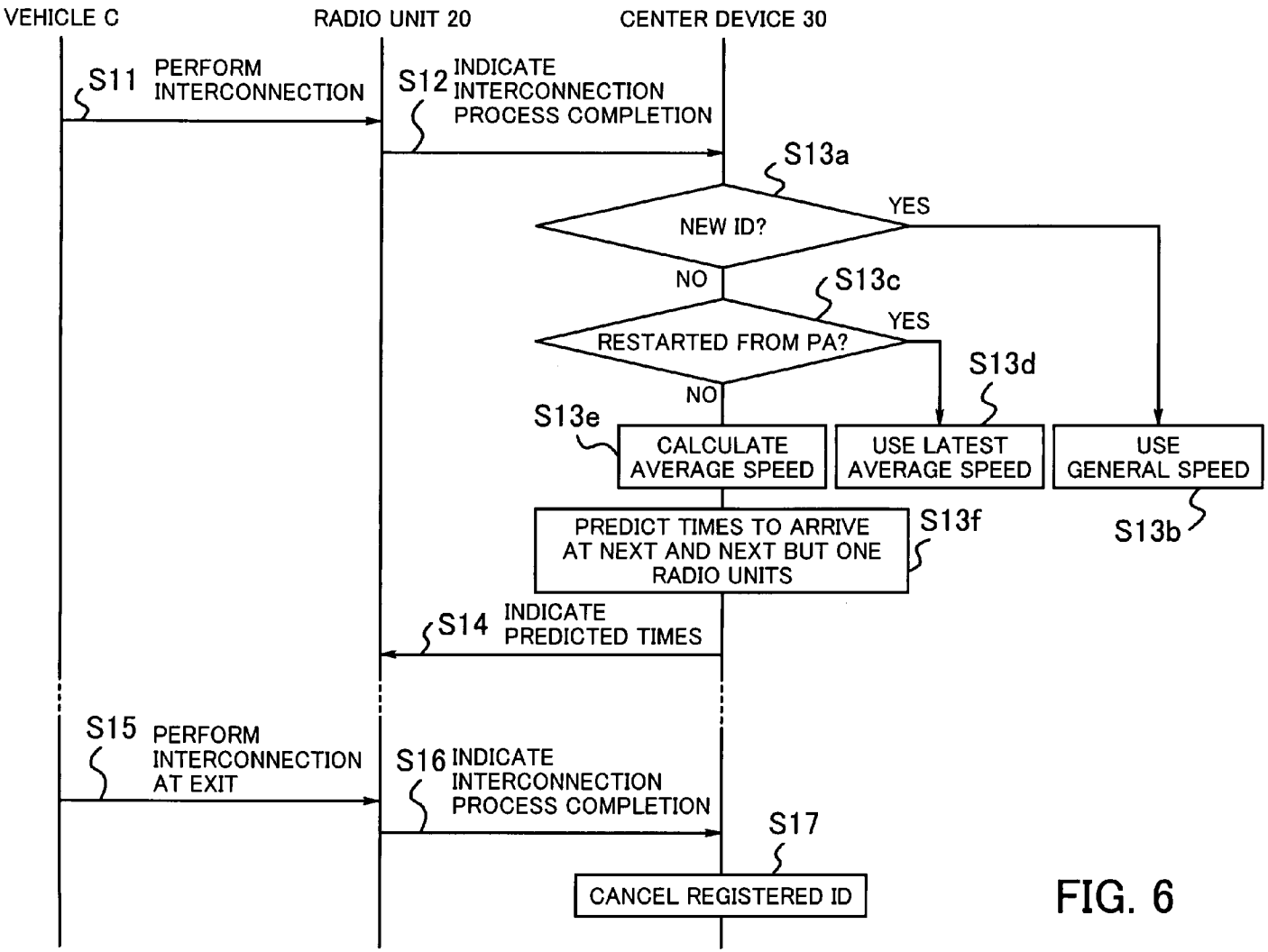
FIG. 6 is a flowchart of an overall operation sequence of the traffic management system.

FIG. 6 shows an overall operation sequence of the traffic management system 1. Each time a vehicle C connects to a radio unit, the center device 30 determines whether the vehicle C is a new vehicle or not, calculates the latest average speed of the vehicle C, and predicts the interconnection time at which the vehicle C will connect to a next radio unit. When the interconnection to the radio unit at the exit of the expressway is completed, the center device 30 will not subsequently predict any interconnection time at which the vehicle C will connect to a radio unit.

[S11] The vehicle C and the radio unit 20 connect to each other.

[S12] The radio unit 20 notifies the center device 30 of the completion of the interconnection process.

[S13*a*] The center device 30 determines whether the vehicle ID of the vehicle C is a new ID or not. If the vehicle ID of the vehicle C is a new ID, then control goes to step S13*b*. If not, then control goes to step S13*c*.

[S13*b*] The center device 30 regards the vehicle C as traveling at a general speed (limited speed) and sets the speed, i.e., the center device 30 temporarily regards the vehicle C as traveling at a general speed in order to calculate a subsequent predicted time.

[S13*c*] The center device 30 determines whether the vehicle C restarts from a service area or a parking area (PA). If the vehicle C restarts from a PA, then control goes to step S13*d*. If not, then control goes to step S13*e*.

[S13*d*] The center device 30 regards the vehicle C as traveling at a latest average speed, i.e., a latest one of calculated speeds, and sets the latest average speed.

[S13*e*] The center device 30 calculates the average speed of the vehicle C, i.e., calculates the speed of the vehicle C when it has passed between radio units most lately.

[S13*f*] The center device 30 predicts the arrival times of the vehicle C at a next radio unit and a next but one radio unit.

[S14] The center device 30 notifies the corresponding radio units of the predicted times. Subsequently, the processing from step S11 is repeated while the vehicle C is traveling on the expressway.

[S15] The vehicle C connects to the radio unit installed at the exit of the expressway.

[S16] The radio unit notifies the center device 30 of the completion of the interconnection process.

[S17] The registration of the vehicle ID of the vehicle C is canceled.

Figure 7:
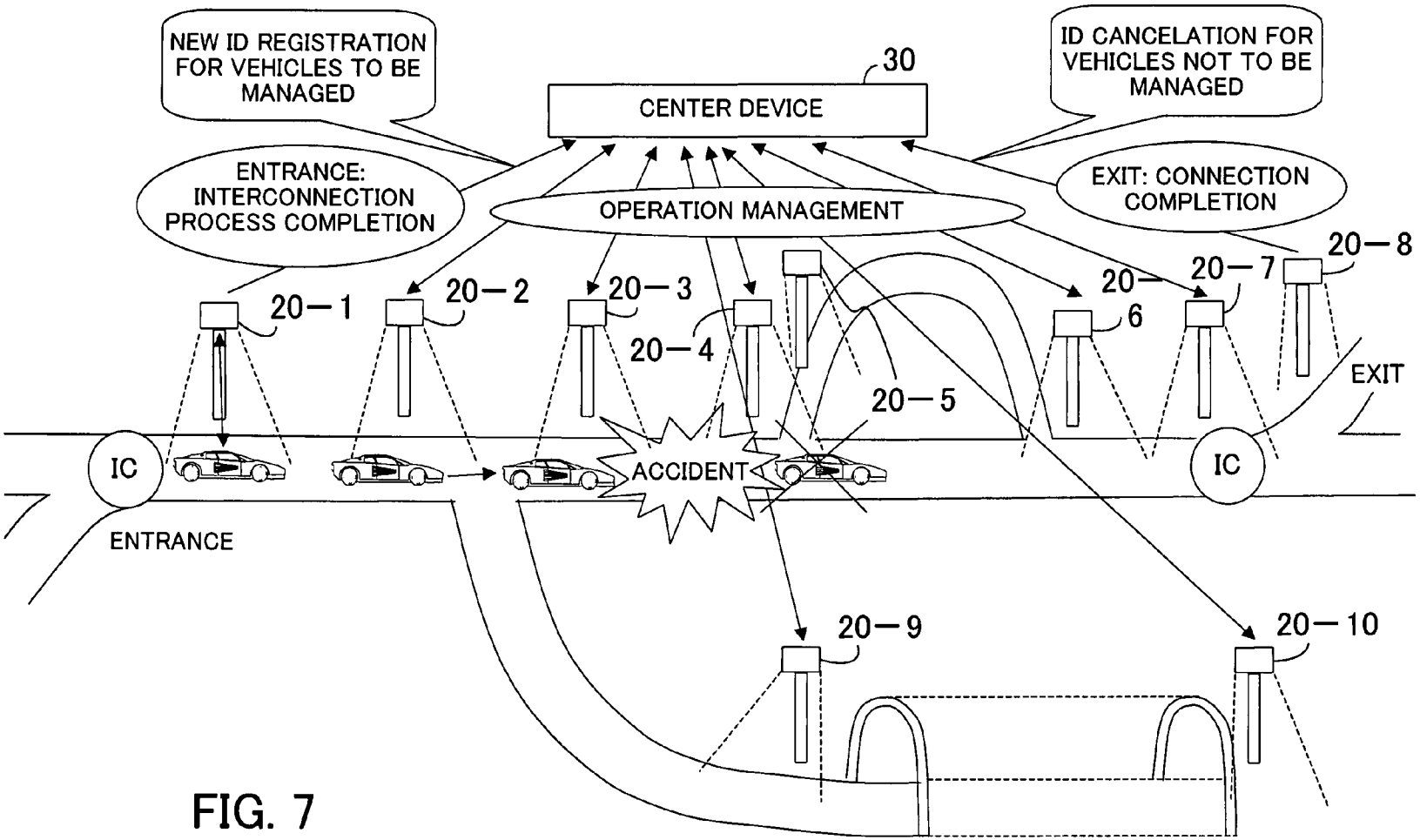
FIG. 7 is a view showing the manner in which the traffic management system operates when a fault occurs.

FIG. 7 shows the manner in which the traffic management system 1 operates when a fault occurs. After the vehicle C has connected to the radio unit 20-3, if the center device 30 receives a notice indicating that an interconnection process is not completed after the expected time, from the radio unit 20-4 which the vehicle C is supposed to pass across next, the center device 30 can judge that the vehicle C has stopped abnormally in the zone between the radio units 20-3, 20-4 based on the overtime that is indicated. Though the communication range of the radio units does not cover the entire system area, the general position of the fault vehicle C can be detected, and it is possible to send a wrecker truck or inspection personnel to the fault vehicle C.

Figure 8:
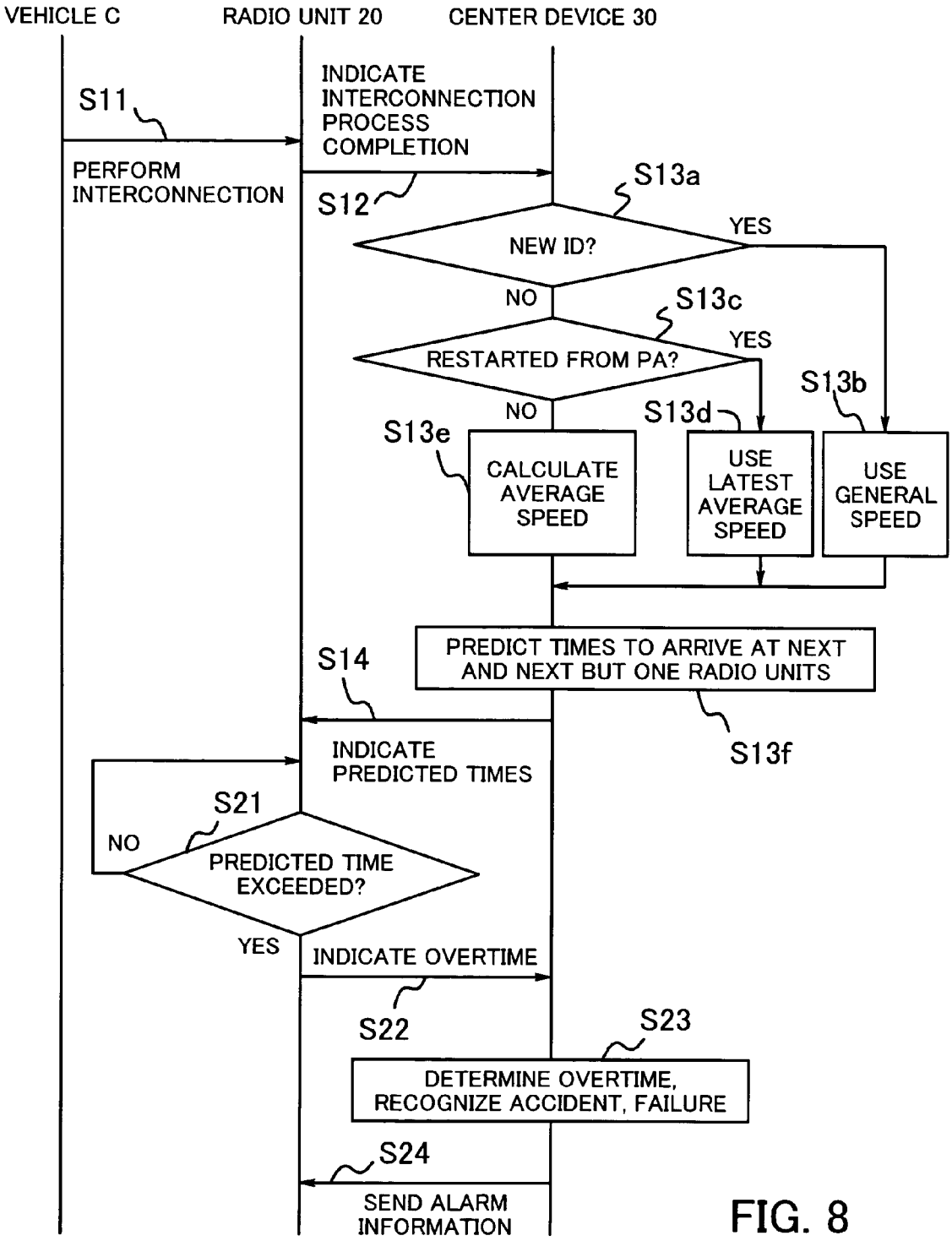
FIG. 8 is a flowchart of an operation sequence of the traffic management system upon the occurrence of a fault.

FIG. 8 shows an operation sequence of the traffic management system 1 upon the occurrence of a fault. If an interconnection process for connecting to the vehicle C is not completed after elapse of a predicted time, then the radio unit 20 keeps sending the overtime to the center device 30. Based on the overtime, the center device 30 recognizes that the vehicle C has suffered a trouble (an accident or a vehicle failure), and sends the trouble information to each radio unit. Steps S11 through S14 are identical to those shown in FIG. 6 and will not be described below.

[S21] It is determined whether the predicted time is exceeded or not. If the predicted time is exceeded, then control goes to step S22.

[S22] The overtime is sent.

[S23] The occurrence of a fault is judged from the received overtime, and it is determined that an accident or a vehicle failure has occurred.

[S24] Alarm information is sent.

Operation of the traffic management system 1 for judging a route will be described below. Radio units are disposed before and after a road junction, and the center device 30 determines the route of the vehicle C based on whether interconnection process completion information is received from the radio unit disposed before the road junction or the radio unit disposed after the road junction.

Figure 9:
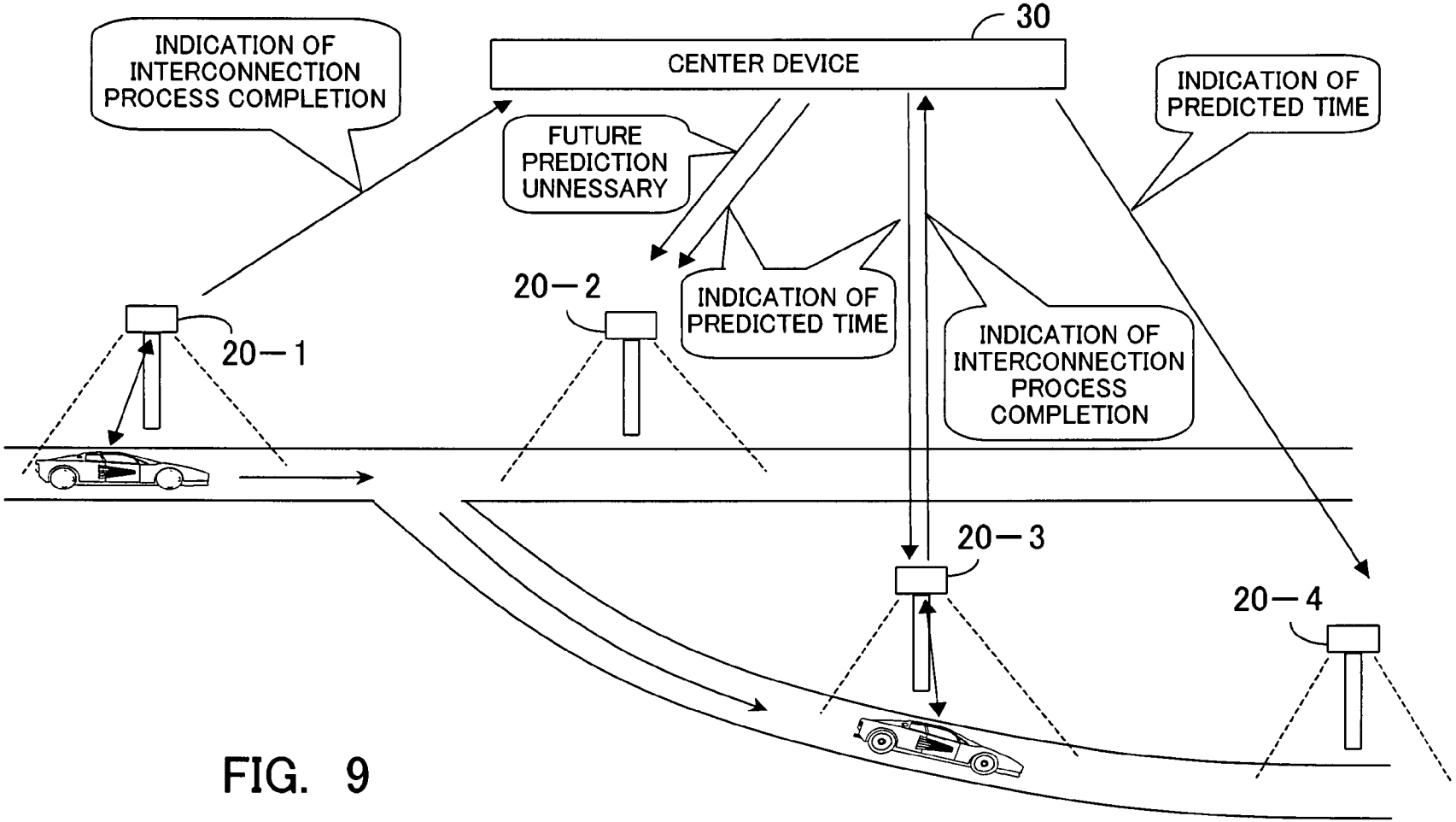
FIG. 9 is a view showing the manner in which the traffic management system operates for judging a route.

FIG. 9 shows the manner in which the traffic management system 1 operates for judging a route. If the road is divided into a plurality of branches ahead of the traveling vehicle C, then the center device 30 predicts times at which the vehicle C is supposed to connect to all radio units that the vehicle C is expected to pass across next. If the center device 30 receives a notice from the radio unit to which the vehicle C has actually connected, then the center device 30 can determine the traveling route of the vehicle C.

For example, if the vehicle C to be managed connects to the radio unit 20-1 and its information is sent to the center device 30, then the center device 30 calculates the speed of the vehicle C. Since the center device 30 knows that the road is divided into two routes ahead the vehicle C, the center device 30 predicts interconnection times for connection to the radio units 20-2, 20-3 from the distances up to these radio units 20-2, 20-3 which the vehicle C is expected to connect to the next time. If the center device 30 has received an interconnection process completion notice that the vehicle C having passed across the radio unit 20-1 has completed its connection to the radio unit 20-3, then the center device 30 does not send subsequent predicted times to those radio units that are positioned on the route following the radio unit 20-2, but predicts and sends times at which the vehicle C will pass across those radio units that are positioned on the route, which is judged as the traveling route of the vehicle C, following the radio unit 20-3.

Figure 10:
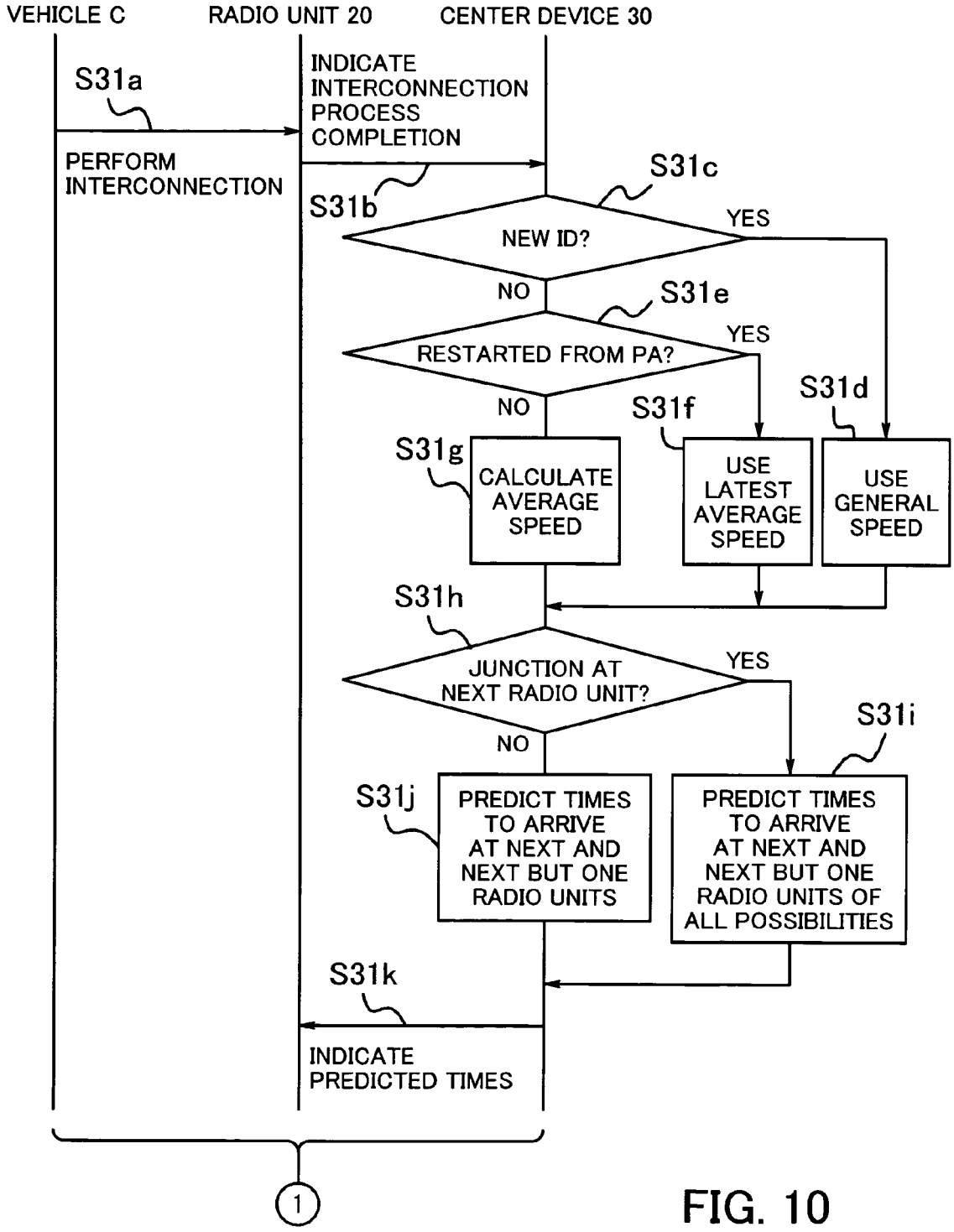
FIGS. 10 and 11 are a flowchart of an operation sequence of the traffic management system for judging a route.
Figure 11:
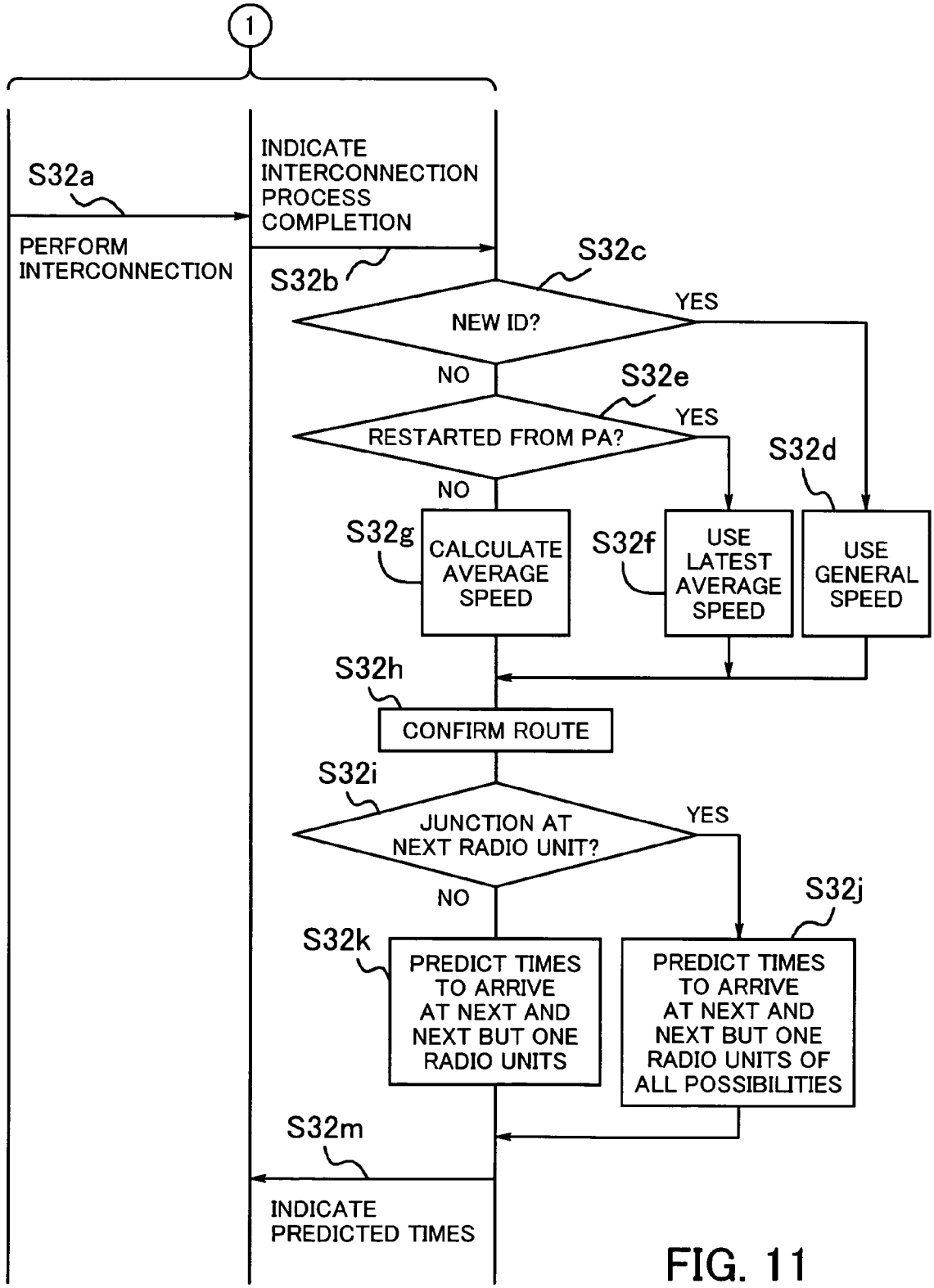

FIGS. 10 and 11 show an operation sequence of the traffic management system 1 for judging a route. After having received interconnection process completion information indicating that the vehicle C has connected to the radio unit prior to the road junction, the center device 30 sends next predicted interconnection times to all the radio units which the vehicle C is expected to connect to the next time. The center device 30 can determine the actual traveling route of the vehicle C by judging which radio unit the vehicle C has subsequently connected to. Thereafter, the center device 30 sends predicted interconnection times to all the radio units on the traveling route of the vehicle C.

[S31*a*] The vehicle C and the radio unit 20 connect to each other.

[S31*b*] The radio unit 20 notifies the center device 30 of the completion of the interconnection process.

[S31*c*] The center device 30 determines whether the vehicle ID of the vehicle C is a new ID or not. If the vehicle ID of the vehicle C is a new ID, then control goes to step S31*d*. Otherwise, control goes to step S31*e*.

[S31*d*] The center device 30 regards the vehicle C as traveling at a general speed and sets the speed.

[S31*e*] The center device 30 determines whether the vehicle C is restarted from a PA. If the vehicle C is restarted from a PA, then control goes to step S31*f*. If not, then control goes to step S31*g*.

[S31*f*] The center device 30 regards the vehicle C as traveling at a latest average speed, and sets the latest average speed.

[S31*g*] The center device 30 calculates the average speed of the vehicle C.

[S31*h*] The center device 30 determines whether there is a road junction prior to next radio units. If there is a road junction, then control goes to step S31*i*. If not, then control goes to step S31*j*.

[S31*i*] The center device 30 predicts times at which the vehicle C will reach next and next but one radio units of all the possibilities (all the radio units in the branches).

[S31*j*] The center device 30 predicts times at which the vehicle C will reach next and next but one radio units.

[S31*k*] The center device 30 sends the predicted times to the corresponding radio units.

[S32*a*] The vehicle C and the radio unit 20 connect to each other.

[S32*b*] The radio unit 20 notifies the center device 30 of the completion of the interconnection process.

[S32*c*] The center device 30 determines whether the vehicle ID of the vehicle C is a new ID or not. If the vehicle ID of the vehicle C is a new ID, then control goes to step S32*d*. Otherwise, control goes to step S32*e*.

[S32*d*] The center device 30 regards the vehicle C as traveling at a general speed and sets the speed.

[S32*e*] The center device 30 determines whether the vehicle C restarts from a PA. If the vehicle C restarts from a PA, then control goes to step S32*f*. If not, then control goes to step S32*g*.

[S32*f*] The center device 30 regards the vehicle C as traveling at a latest average speed, and sets the latest average speed.

[S32*g*] The center device 30 calculates the average speed of the vehicle C.

[S32*h*] The center device 30 confirms the route that the vehicle C is traveling, i.e., confirms which branched route the vehicle C is traveling.

[S32*i*] The center device 30 determines whether there is a road junction prior to next radio units. If there is a road junction, then control goes to step S32*j*. If not, then control goes to step S32*k*.

[S32*j*] The center device 30 predicts times at which the vehicle C will reach next and next but one radio units of all the possibilities (all the radio units in the branches).

[S32*k*] The center device 30 predicts times at which the vehicle C will reach next and next but one radio units.

[S32*m*] The center device 30 sends the predicted times to the corresponding radio units. The above operation sequence will subsequently be repeated.

Operation of the traffic management system 1 when a fault occurs on a vehicle while judging a route will be described below. After the vehicle C enters a road branch, if the center device 30 receives an overtime from a radio unit located after the junction, then the center device 30 judges that a fault has occurred near the junction, and sends alarm information to vehicles that are traveling near the junction.

Figure 12:
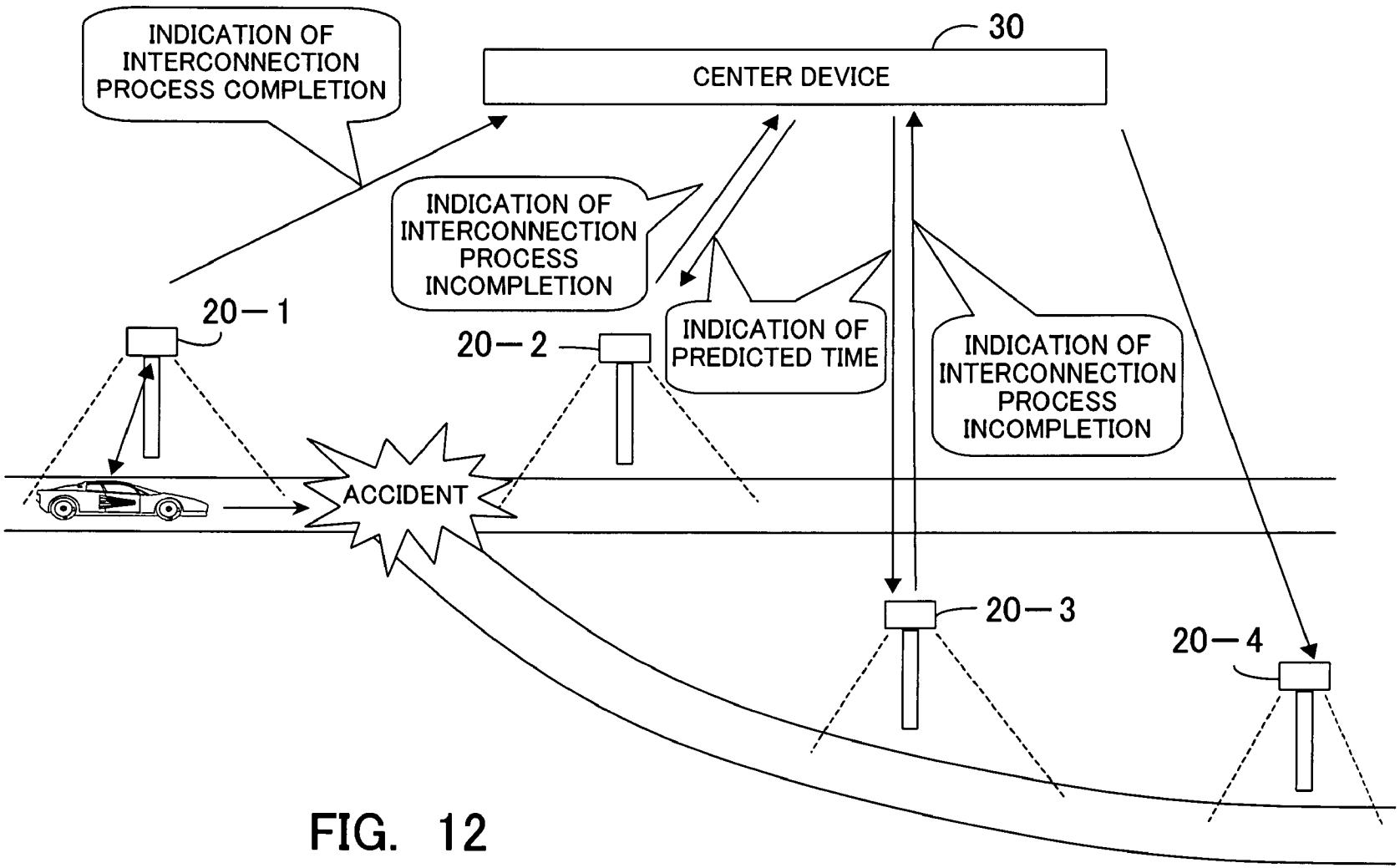
FIG. 12 is a view showing the manner in which the traffic management system operates when a fault occurs on a vehicle while judging a route.

FIG. 12 shows the manner in which the traffic management system 1 operates when a fault occurs on a vehicle while judging a route. If the road is divided into a plurality of branches ahead of the traveling vehicle C, then the center device 30 predicts times at which the vehicle C is supposed to connect to all radio units that the vehicle C is expected to pass across next. If the center device 30 does not receive an interconnection process completion notice from any of the predicted radio units, then the center device 30 can recognize that the vehicle C has suffered a fault somewhere in the zone up to the predicted radio units. Though the communication range of the radio units does not cover the entire system area, the general position of the fault vehicle C can be detected, making it possible to send a wrecker truck or inspection personnel to the fault vehicle C.

For example, if the vehicle C to be managed connects to the radio unit 20-1 and its information is sent to the center device 30, then the center device 30 calculates the speed of the vehicle C. Since the center device 30 knows that the road is divided into two routes ahead the vehicle C, the center device 30 predicts interconnection times for connection to the radio units 20-2, 20-3 from the distances up to these radio units 20-2, 20-3 which the vehicle C is expected to connect to the next time. If an interconnection process for connecting to the vehicle C is not completed after elapse of the predicted time, then the radio units 20 keep sending the overtime to the center device 30. Based on the overtime, the center device 30 recognizes that the vehicle C has suffered a fault somewhere in the zone between the radio units 20-1, 20-2 or in the zone between the radio units 20-1, 20-3, and sends the fault information to each radio unit.

Figure 13:
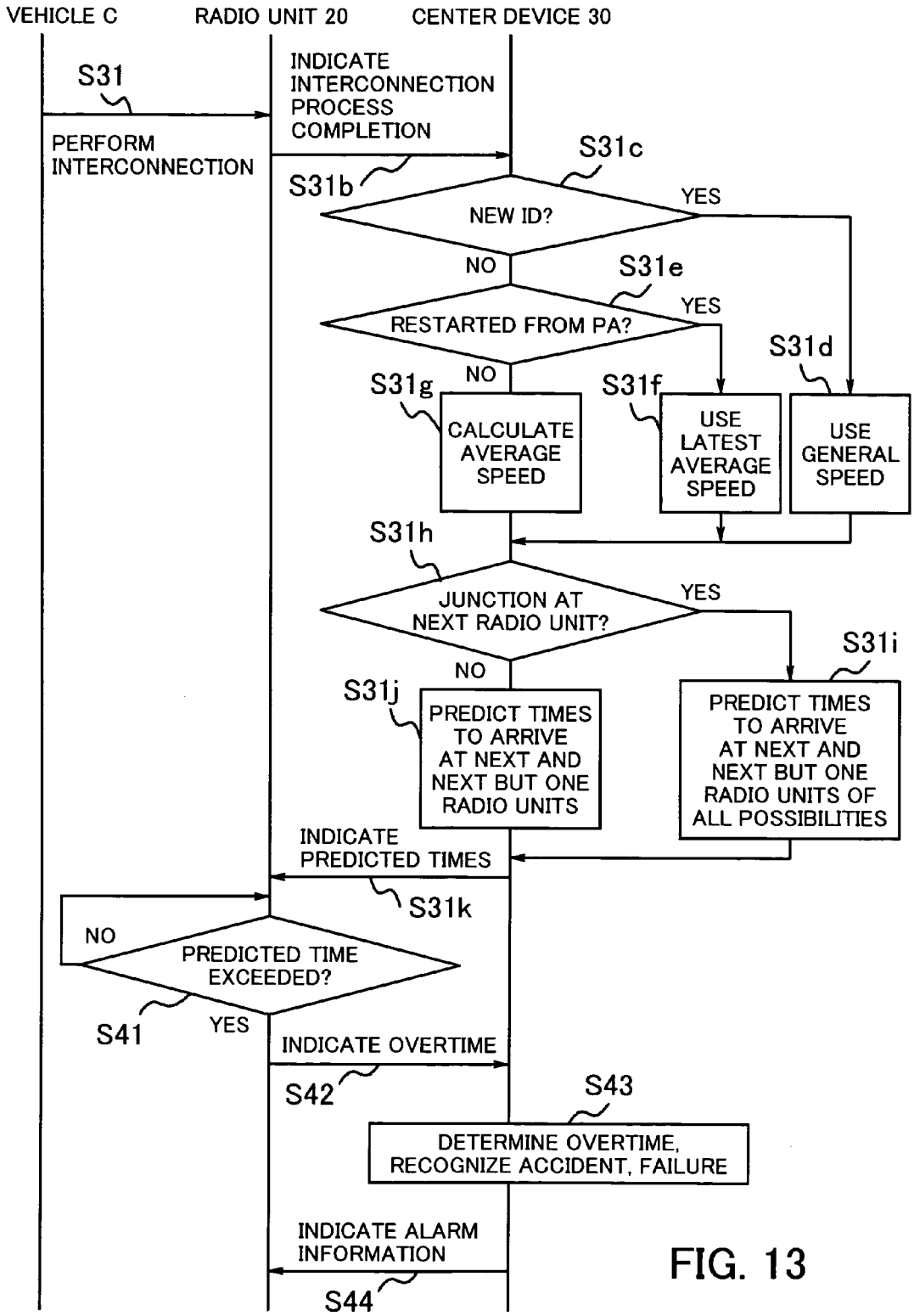
FIG. 13 is a flowchart of an operation sequence of the traffic management system upon the occurrence of a fault in a road junction.

FIG. 13 shows an operation sequence of the traffic management system 1 upon the occurrence of a fault in a road junction. If the center device 30 receives an interconnection process incompletion (overtime) notice after elapse of predicted times from all expected radio units, then the center device 30 recognizes that a fault has occurred on the vehicle C, and sends the fault information from the radio units to following vehicles. Steps S31*a* through S31*k* are identical to those shown in FIG. 10 and will not be described below.

[S41] It is determined whether the predicted time is exceeded or not. If the predicted time is exceeded, then control goes to step S42.

[S42] The overtime is sent.

[S43] The occurrence of a fault is judged from the received overtime, and it is determined that an accident or a vehicle failure has occurred.

[S44] Alarm information is sent.

Operation of the traffic management system 1 for judging a route with radio units installed near a PA will be described below. Radio units are installed at the entrance and exit of a PA and within the PA. Based on which radio unit a vehicle connects to after having connected to the radio unit at the entrance of the PA, it is determined whether the vehicle has entered the PA or has passed by without entering the PA. Furthermore, based on information transmitted from the radio unit in the PA, parking information of the PA is sent to following vehicles.

Figure 14:
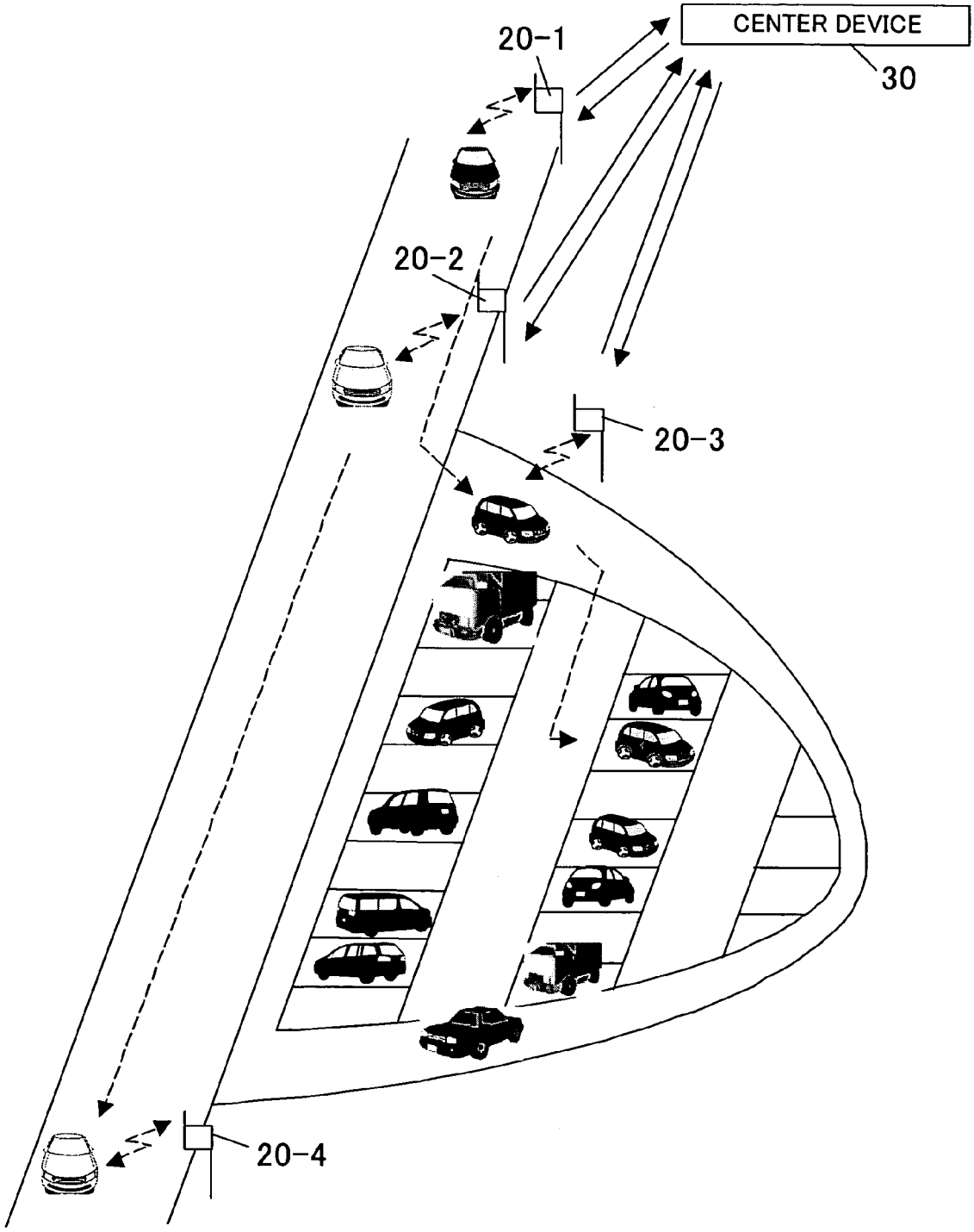
FIG. 14 is a view showing the manner in which the traffic management system operates for judging a route with radio units installed near a PA (parking area)

FIG. 14 shows the manner in which the traffic management system 1 operates for judging a route with radio units installed near a PA. If there is a PA ahead of the traveling vehicle C and there are radio units installed at the entrance and exit of the PA and a radio unit capable of communicating with only those vehicles having entered the PA, then after the vehicle C has completed its connection to the radio unit at the entrance of the PA, the center device 30 predicts times for connection of the vehicle C to radio units which the vehicle C is expected to pass across the next time.

If there is a notice from the radio unit to which the vehicle C has actually connected, it can be determined whether the vehicle C has been parked in the PA or has traveled on without being parked in the PA, based on which radio unit the vehicle C has completed its connection to. Those vehicles which are going to use the PA can receive the present PA usage status from the radio unit before the entrance of the PA based on the information managed by the center device 30.

For example, the center device 30 calculates the speed of the vehicle C from the interconnection process completion information indicating that the vehicle C to be managed has connected to the radio units 20-1, 20-2. The center device 30 then predicts interconnection times at which the vehicle C is expected to connect to the radio units 20-3, 20-4 the next time from the distances up to these radio units 20-3, 20-4. If the vehicle C has actually completed its connection to the radio unit 20-4 after the radio unit 20-2, it can be determined that the vehicle C has passed by the PA.

The center device 30 can also judge the parking status of the PA from the difference between the number of vehicles which have completed their connection to the radio unit 20-3 and the number of vehicles which have completed their connection to the radio unit 20-4, and send the information indicative of the parking status of the PA to vehicles traveling near the entrance of the PA.

Figure 15:
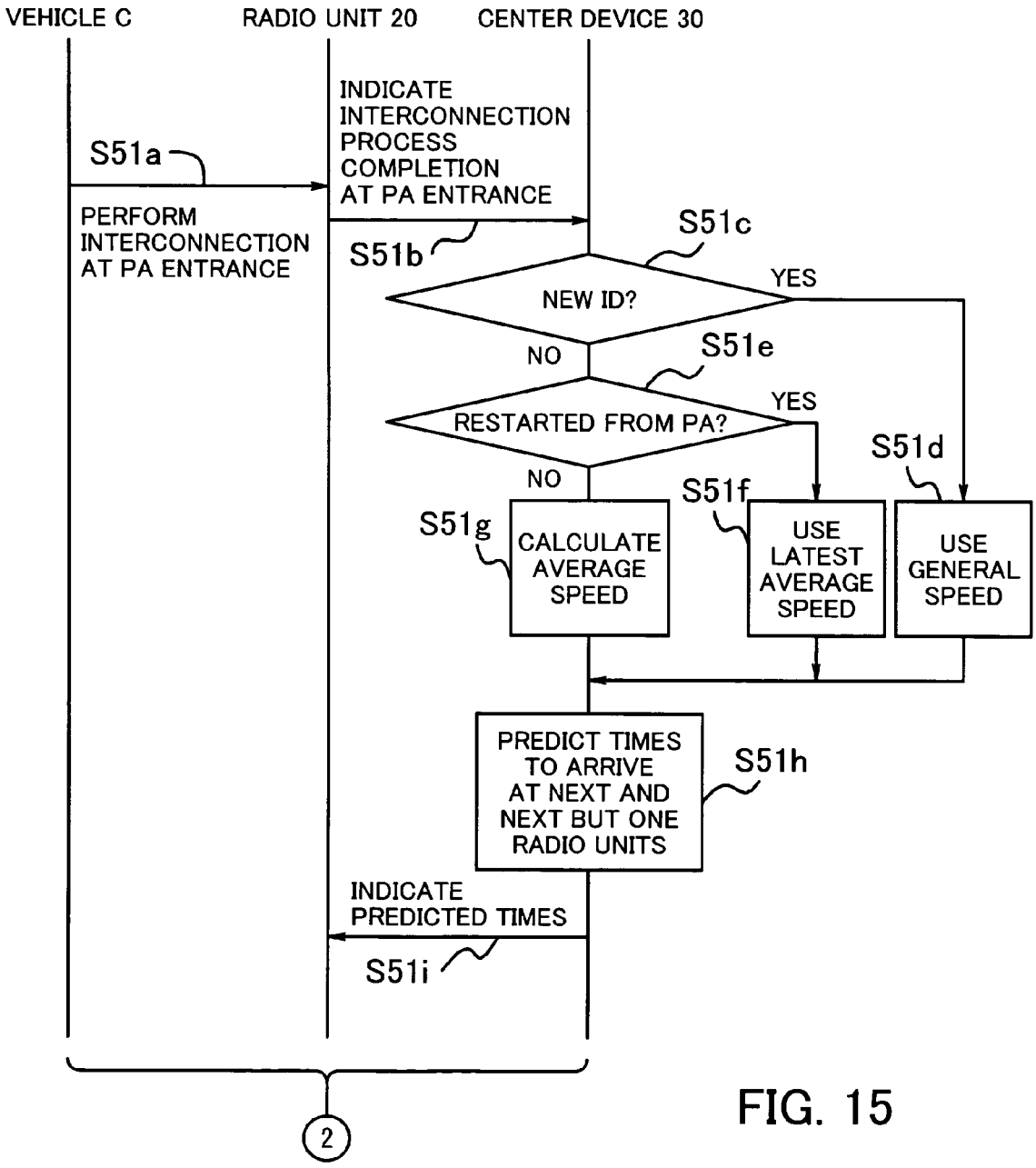
FIGS. 15 and 16 are a flowchart of an operation sequence of the traffic management system for judging a route with radio units installed near a PA.
Figure 16:
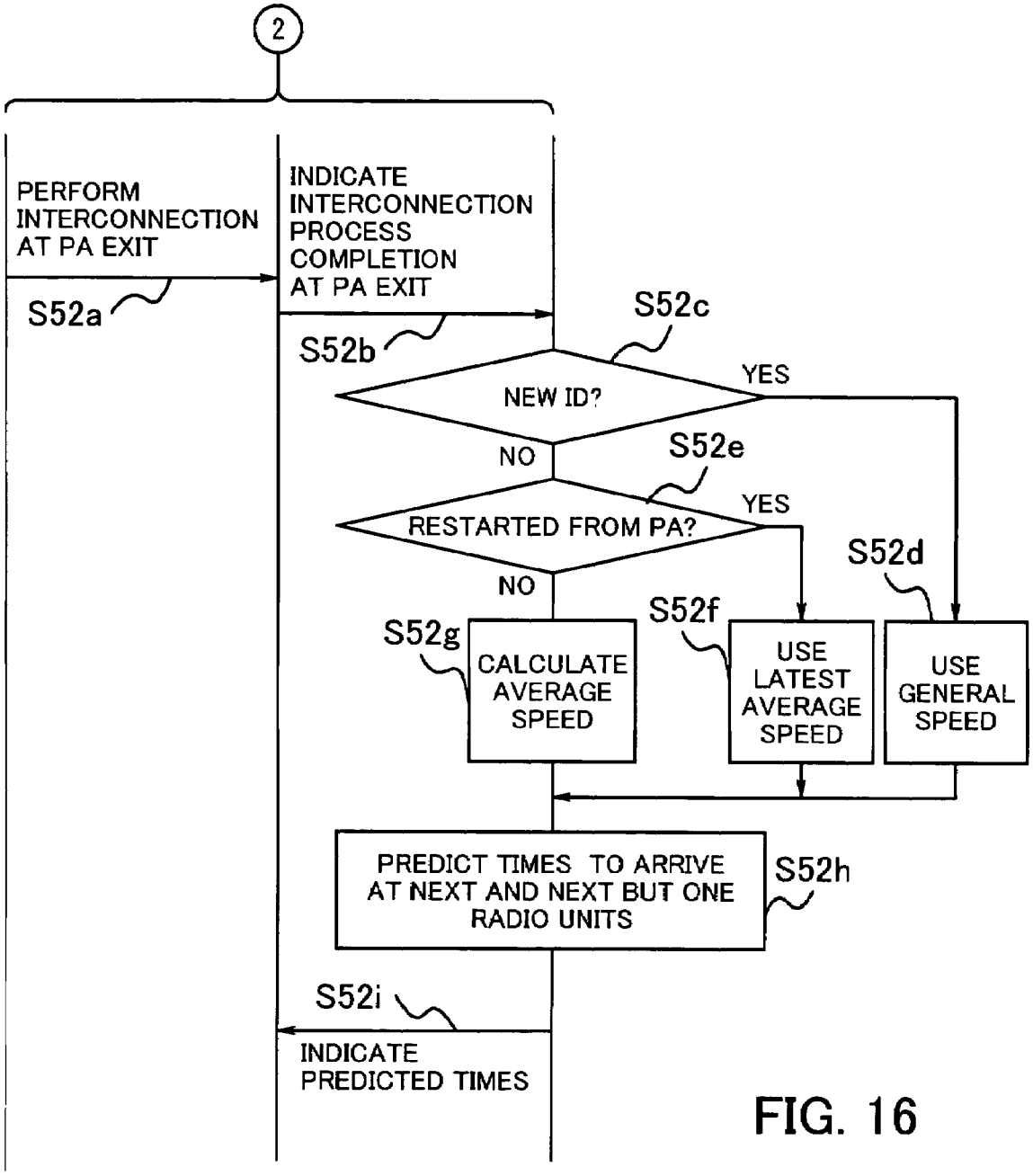

FIGS. 15 and 16 show an operation sequence of the traffic management system 1 for judging a route with radio units installed near a PA. Having received interconnection process completion information from a radio unit before a PA, the center device 30 sends next predicted interconnection times to all the radio units that the vehicle C is expected to connect to. Thereafter, if the vehicle C does not connect to a radio unit which is capable of connecting to vehicles only within the PA, but connects to a radio unit at the exit of the PA, then it can be determined that the vehicle C has not entered the PA, but has traveled on. Conversely, if the vehicle C connects to a radio unit which is capable of connecting to vehicles only within the PA, but does not connect to a radio unit at the exit of the PA, then it can be determined that the vehicle C has entered the PA. Thereafter, predicted interconnection times are sent to succeeding radio units.

[S51*a*] The vehicle C and the radio unit 20 at the entrance of the PA connect to each other.

[S51*b*] The radio unit 20 notifies the center device 30 of the completion of the interconnection process.

[S51*c*] The center device 30 determines whether the vehicle ID of the vehicle C is a new ID or not. If the vehicle ID of the vehicle C is a new ID, then control goes to step S51*d*. If not, then control goes to step S51*e*.

[S51*d*] The center device 30 regards the vehicle C as traveling at a general speed and sets the speed.

[S51*e*] The center device 30 determines whether the vehicle C is restarted from a PA. If the vehicle C is restarted from a PA, then control goes to step S51*f*. If not, then control goes to step S51*g*.

[S51*f*] The center device 30 regards the vehicle C as traveling at a latest average speed, and sets the latest average speed.

[S51*g*] The center device 30 calculates the average speed of the vehicle C.

[S51*h*] The center device 30 predicts times at which the vehicle C will reach next and next but one radio units.

[S51*i*] The center device 30 sends the predicted times to the corresponding radio units.

[S52*a*] The vehicle C and the radio unit 20 at the exit of the PA connect to each other.

[S52*b*] The radio unit 20 notifies the center device 30 of the completion of the interconnection process.

[S52*c*] The center device 30 determines whether the vehicle ID of the vehicle C is a new ID or not. If the vehicle ID of the vehicle C is a new ID, then control goes to step S52*d*. If not, then control goes to step S52*e*.

[S52*d*] The center device 30 regards the vehicle C as traveling at a general speed and sets the speed.

[S52*e*] The center device 30 determines whether the vehicle C is restarted from a PA. If the vehicle C is restarted from a PA, then control goes to step S52*f*. If not, then control goes to step S52*g*.

[S52*f*] The center device 30 regards the vehicle C as traveling at a latest average speed, and sets the latest average speed.

[S52*g*] The center device 30 calculates the average speed of the vehicle C.

[S52*h*] The center device 30 predicts times at which the vehicle C will reach next and next but one radio units.

[S52*i*] The center device 30 sends the predicted times to the corresponding radio units.

Operation of the traffic management system 1 upon the occurrence of a fault on a vehicle near a PA will be described below. Radio units are installed at the entrance and exit of a PA. If the center device 30 receives interconnection process completion information from the radio unit at the entrance of the PA, and does not receive interconnection process completion information, but receives an overtime, from the radio unit at the exit of the PA, then the center device 30 determines that a fault has occurred near the PA and sends alarm information to those vehicles which pass near the PA.

Figure 17:
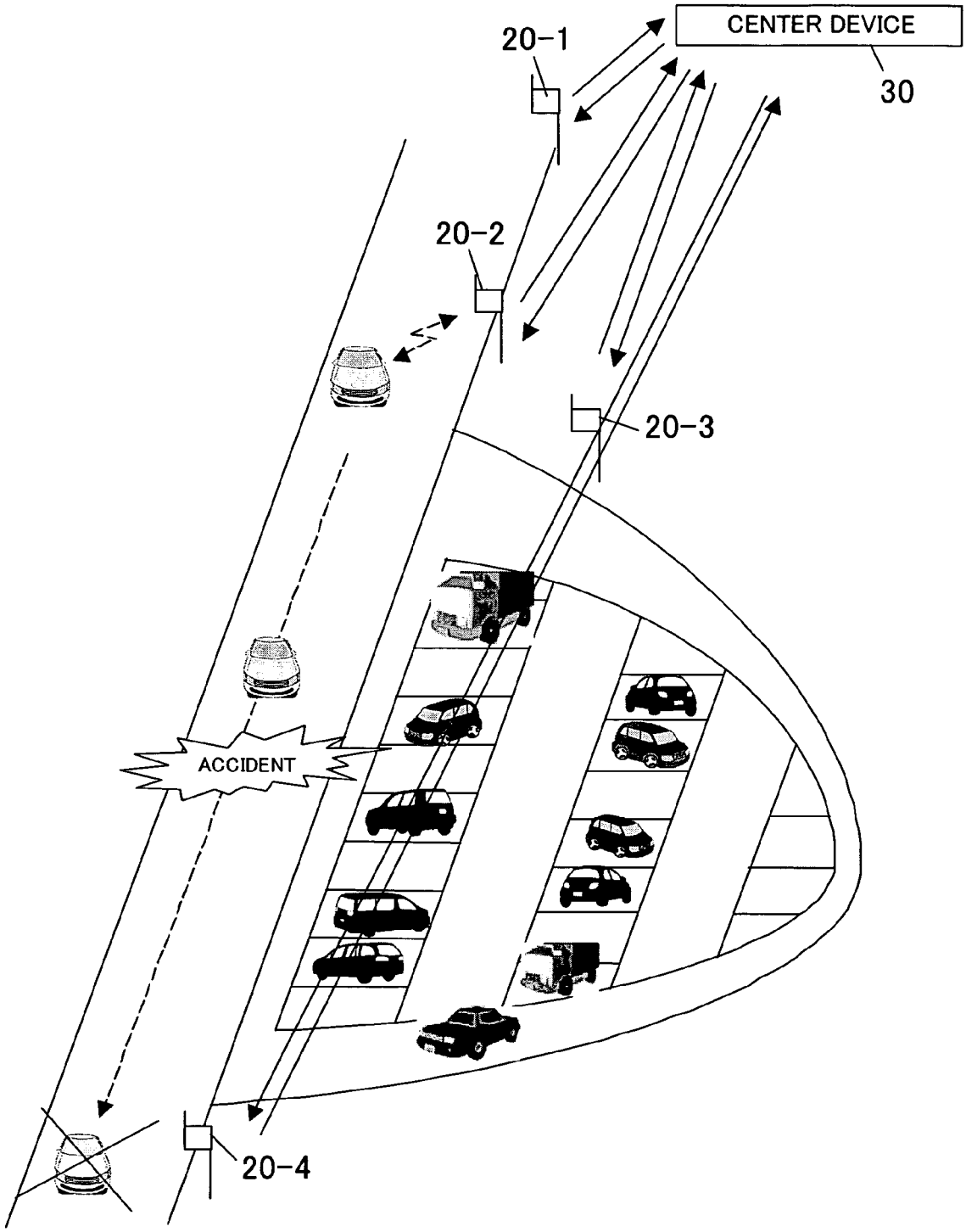
FIG. 17 is a view showing the manner in which the traffic management system operates when a fault occurs on a vehicle near a PA.

FIG. 17 shows the manner in which the traffic management system 1 operates when a fault occurs on a vehicle near a PA. There is a PA ahead of the traveling vehicle C and there are radio units installed at the entrance and exit of the PA and a radio unit capable of communicating with only those vehicles having entered the PA. After the vehicle C has completed its connection to the radio unit at the entrance of the PA, the center device 30 predicts times at which the vehicle C is supposed to connect to all radio units that the vehicle C is expected to pass across next. If the center device 30 receives a notice from a radio unit indicating that the vehicle C has not completed to its connection to the radio unit after elapse of the predicted time, then the center device 30 judges that the vehicle C has suffered a fault based on the overtime.

For example, the center device 30 calculates the speed of the vehicle C from the interconnection process completion information indicating that the vehicle C to be managed has connected to the radio units 20-1, 20-2. The center device 30 then predicts interconnection times at which the vehicle C is expected to connect to the radio units 20-3, 20-4 the next time from the distances up to these radio units 20-3, 20-4. If the center device 30 receives a notice indicating that no connection from the radio units 20-3, 20-4 to the vehicle C is completed after the elapse of the overtime, then the center device 30 judges that it is highly likely for the vehicle C to have suffered a trouble in the road zone outside of the PA, providing there is a radio unit installed in a location for connecting, without fail, to all vehicles that have entered the PA.

Figure 18:
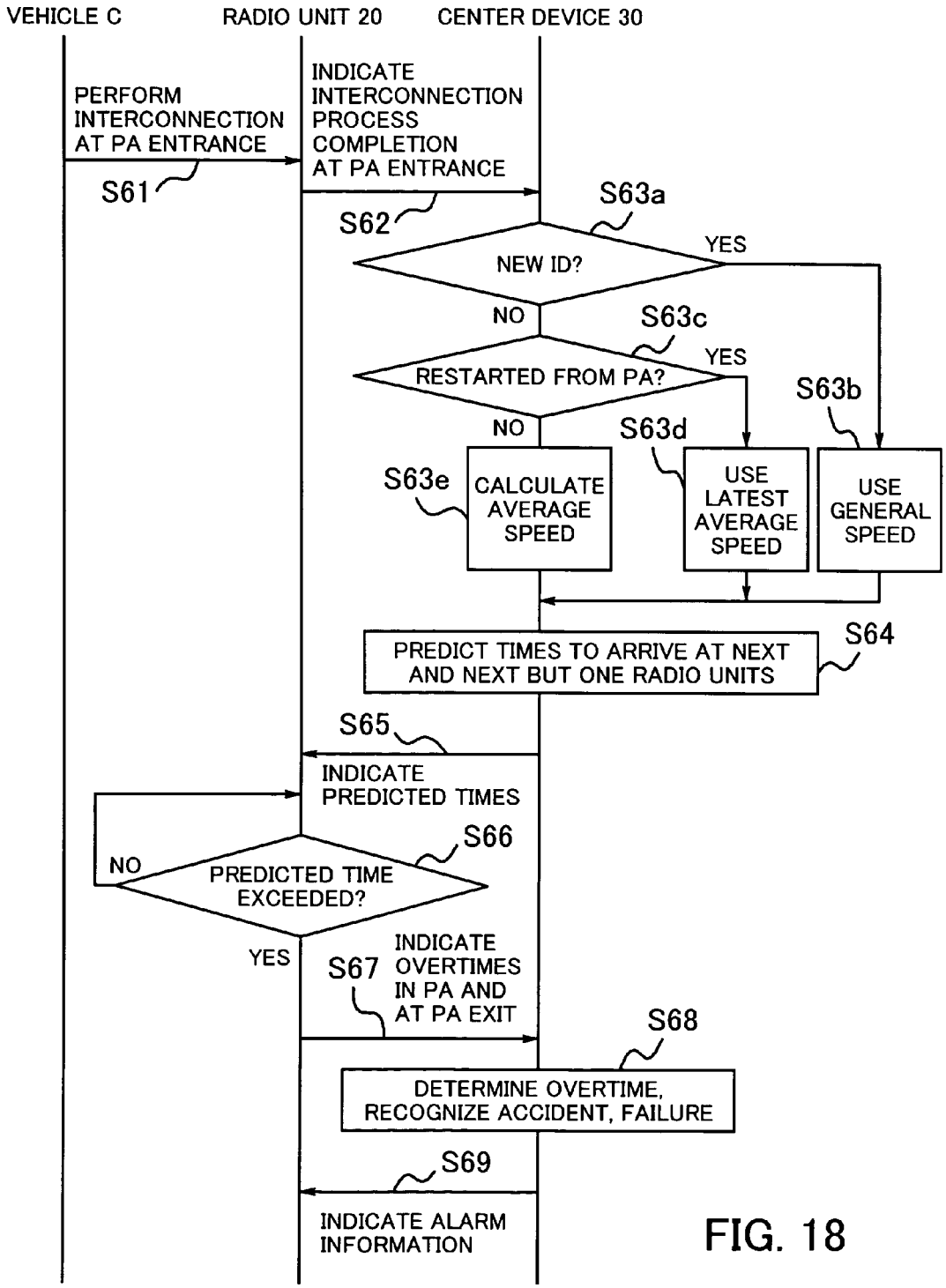
FIG. 18 is a flowchart of an operation sequence of the traffic management system upon the occurrence of a fault on a vehicle near a PA.

FIG. 18 shows an operation sequence of the traffic management system 1 upon the occurrence of a fault on a vehicle near a PA. Having received interconnection process completion information from a radio unit at the entrance of a PA, the center device 30 sends next predicted interconnection times to all the radio units that the vehicle C is expected to connect to. Thereafter, if the center device 30 receives a notice indicating that the vehicle has not completed its connection to a radio unit after elapse of the predicted time, then as the vehicle C has not connected to a radio unit in the PA, the center device judges that the vehicle C has not entered the PA, but has suffered a fault on the road outside of the PA, and sends the fault information to the radio units.

[S61] The vehicle C and the radio unit 20 at the entrance of the PA connect to each other.

[S62] The radio unit 20 notifies the center device 30 of the completion of the interconnection process.

[S63*a*] The center device 30 determines whether the vehicle ID of the vehicle C is a new ID or not. If the vehicle ID of the vehicle C is a new ID, then control goes to step S63*b*. If not, then control goes to step 63*c*.

[S63*b*] The center device 30 regards the vehicle C as traveling at a general speed and sets the speed.

[S63*c*] The center device 30 determines whether the vehicle C is restarted from a PA. If the vehicle C is restarted from a PA, then control goes to step S63*d*. If not, then control goes to step S63*e*.

[S63*d*] The center device 30 regards the vehicle C as traveling at a latest average speed, and sets the latest average speed.

[S63*e*] The center device 30 calculates the average speed of the vehicle C.

[S64] The center device 30 predicts times at which the vehicle C will reach next and next but one radio units.

[S65] The center device 30 sends the predicted times to the corresponding radio units.

[S66] It is determined whether the predicted time is exceeded or not. If the predicted time is exceeded, then control goes to step S67.

[S67] The overtime is sent.

[S68] The occurrence of a fault is judged from the received overtime, and it is determined that an accident or a vehicle failure has occurred.

[S69] Alarm information is sent.

The classification of fault levels will be described below. The center device 30 recognizes the risk level of a fault, sets a risk level, and changes the notification ratio of alarm information depending on the magnitude of the risk level. For example, if the overtime is within 1 minute, then the risk level is set to risk level 1 (parked on the road side). If the overtime is within 10 minutes, then the risk level is set to risk level 2 (blocking one lane). If the overtime is more than 10 minutes, then the risk level is set to risk level 3 (blocking all lanes). At risk level 3, the center device 30 keeps sending alarm information to following vehicles uninterruptedly. At risk level 2, the center device 30 sends alarm information once in 15 seconds. At risk level 1, the center device 30 sends alarm information once in 1 minute. In this manner, the notification ratio of alarm information is changed depending on the magnitude of the risk level.

Figure 19:
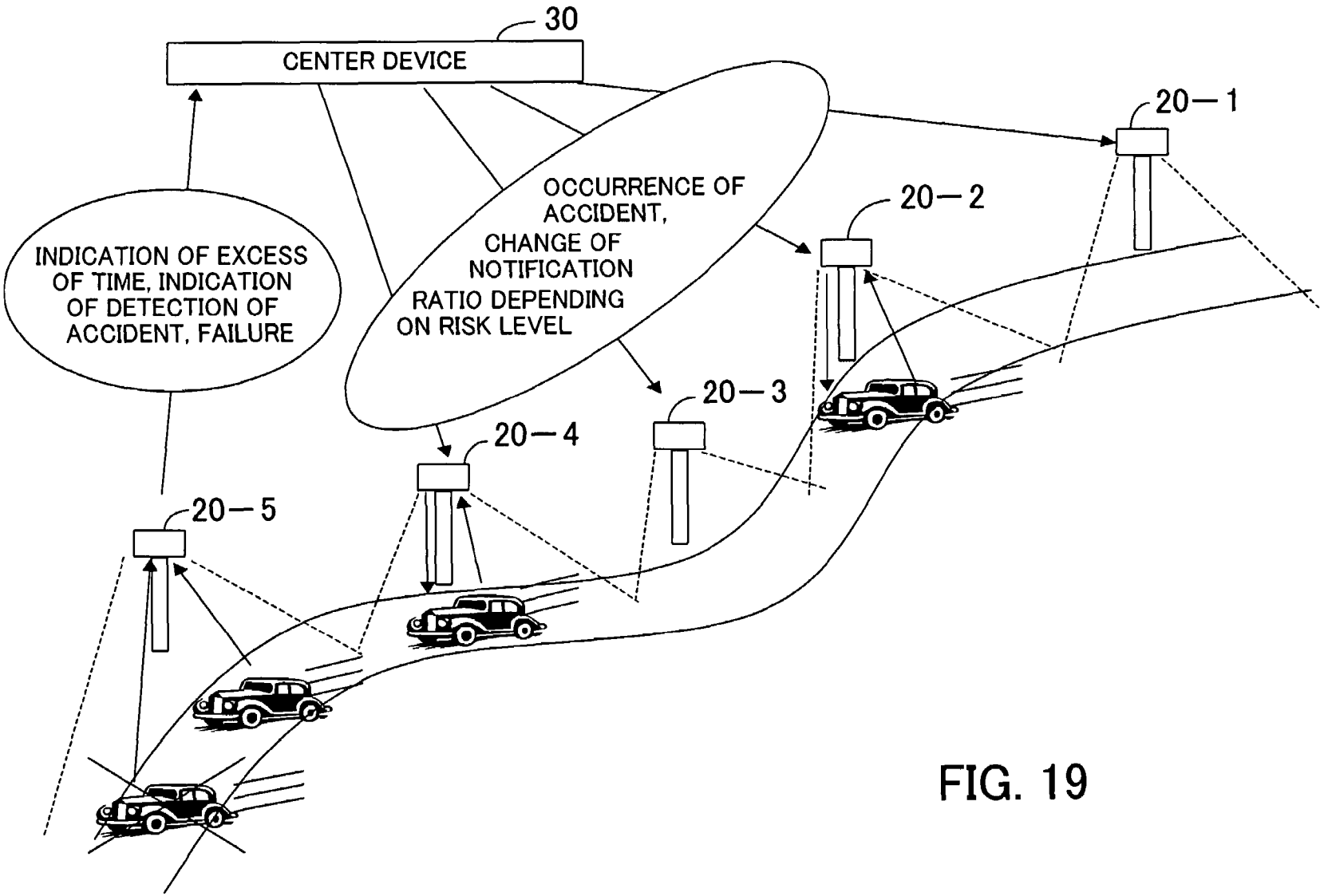
FIG. 19 is a view showing the manner in which the traffic management system operates to classify fault levels.

FIG. 19 shows the manner in which the traffic management system 1 operates to classify fault levels. When a planned interconnection time is exceeded, if a connection to the vehicle C is not completed or if there is information sent from another vehicle, then it is checked against information indicative of an accident involving the vehicle C or a failure of the vehicle C to recognize a risk level. Based on the recognized risk level, the notification ratio of alarm information normally sent from the radio unit to the vehicle C is changed.

For example, if the vehicle C suffers a fault at the radio unit 20-5 and an accident is reported from another vehicle, then the risk level of the accident or failure is judged based on the accident information. If the vehicle C is parked on the road side, then the accident information is compared with the risk level data to recognize risk level 1. If there is no information from another vehicle and the vehicle C does not connect to a radio unit even at the planned interconnection time, then the radio unit sends overtime information to the center device 30. The center device 30 checks the overtime information against overtime-related risk level data to confirm the risk level of the accident involving the vehicle C or the failure of the vehicle C. The center device 30 sends a notification ratio depending on the confirmed risk level to all the radio units to notify following vehicles of the situation.

Figure 20:
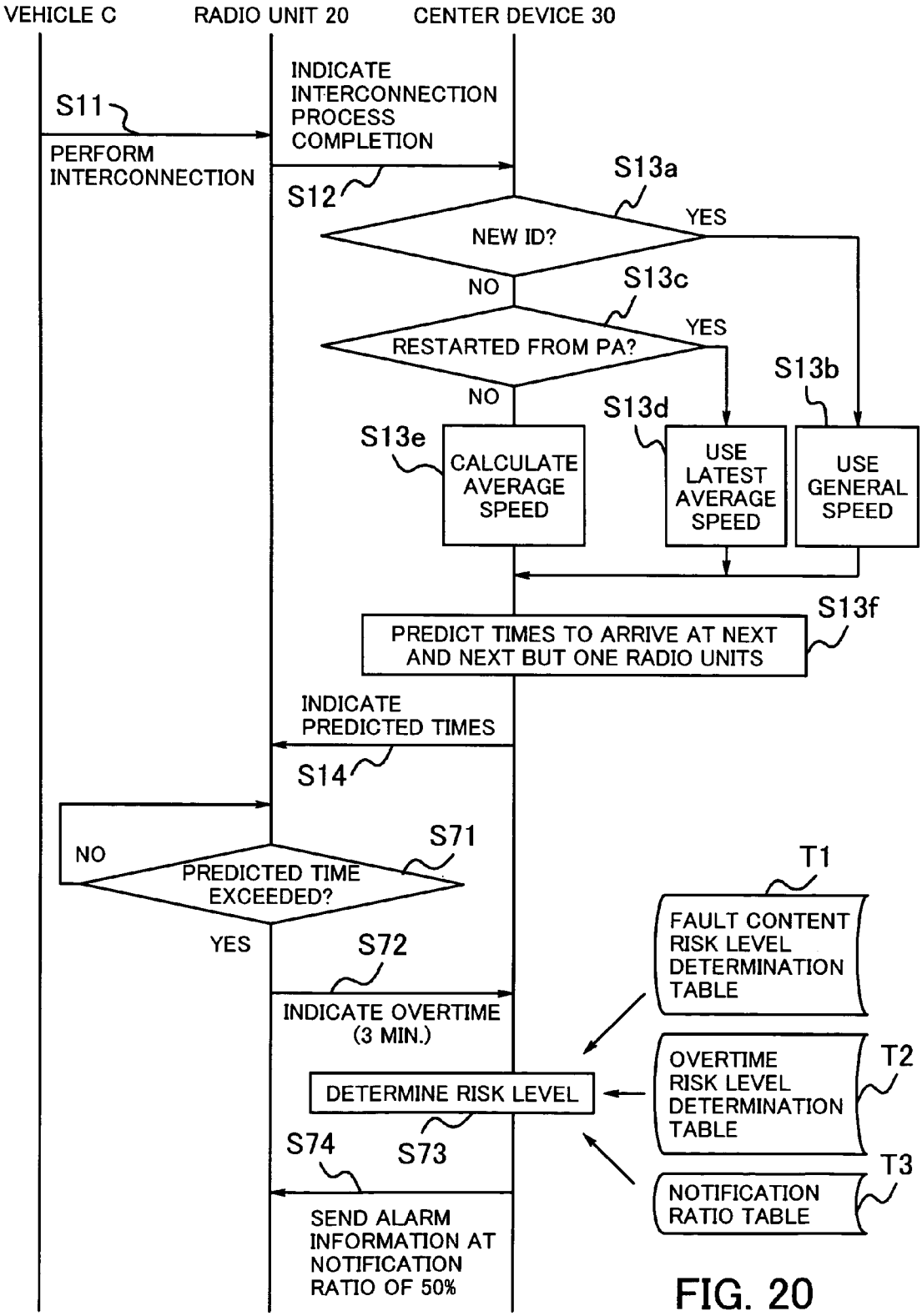
FIG. 20 is a flowchart of an operation sequence of the traffic management system for classifying fault levels.

FIG. 20 shows an operation sequence of the traffic management system 1 for classifying fault levels. The center device 30 compares received information with risk level determining data registered therein to determine the fault state of the vehicle C, and changes a notification ratio of information to be sent from the radio units to following vehicles C. Steps S11 through S14 are identical to those shown in FIG. 6 and will not be described below.

[S71] It is determined whether the predicted time is exceeded or not. If the predicted time is exceeded, then control goes to step S22.

[S72] The overtime is sent. The overtime is 3 minutes.

[S73] A risk level is determined from the received overtime. The risk level is determined using a fault content risk level determination table T1, an overtime risk level determination table T2, and a notification ratio table T3 which are stored in the data registration unit 31*e* shown in FIG. 4. FIG. 21 shows the fault content risk level determination table T1, the overtime risk level determination table T2, and the notification ratio table T3.

The fault content risk level determination table T1 is a table containing fault contents and risk levels in combination. In FIG. 21, the risk level is 1 for a vehicle parked on the road side, the risk level is 2 for a vehicle blocking one lane, and the risk level is 3 for a vehicle blocking all lanes.

The overtime risk level determination table T2 is a table containing risk levels and overtimes in combination. In FIG. 21, the risk level is 1 if the overtime is within 1 minute, the risk level is 2 if the overtime is within 5 minutes, and the risk level is 3 if the overtime is more than 5 minutes.

The notification ratio table T3 is a table containing risk levels and notification ratio in combination. In FIG. 21, the notification ratio is 10% if the risk level is 1, the notification ratio is 50% if the risk level is 2, and the notification ratio is 100% if the risk level is 3. In FIG. 20, since the overtime is 3 minutes, the risk level is judged as 2 and the notification ratio is judged as 50%.

[S74] Alarm information is set at the notification ratio of 50%.

Operation of the traffic management system 1 for changing a notification ratio of alarm information depending on the distance from a fault occurrence site will be described below. The center device 30 sets the notification ratio of alarm information to a higher value for vehicles which are traveling in a region near a fault occurrence site, and to a lower value for vehicles which are traveling in a region remote from a fault occurrence site.

Figure 22:
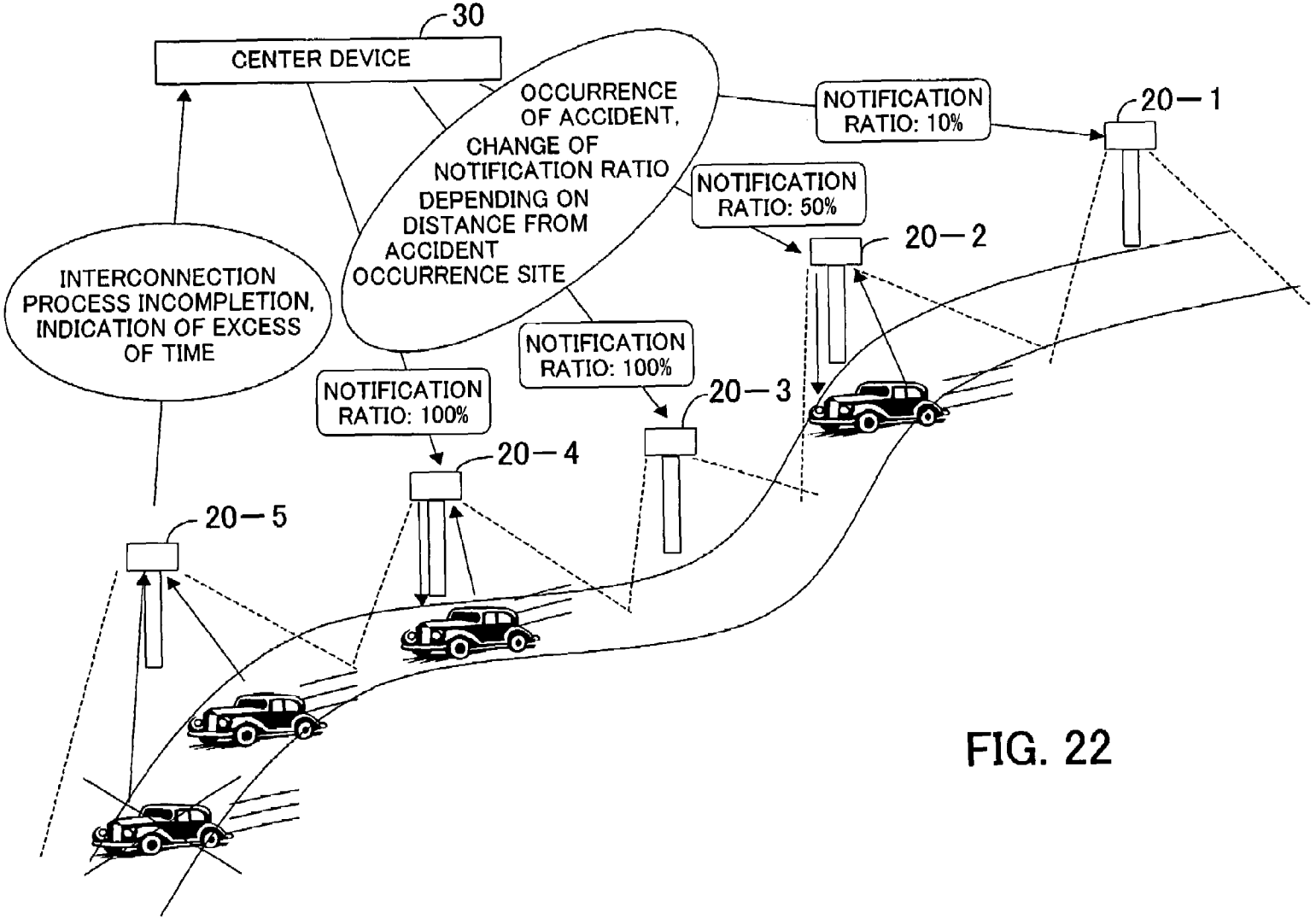
FIG. 22 is a view showing the manner in which the traffic management system operates for changing a notification ratio of alarm information depending on the distance from a fault occurrence site.

FIG. 22 shows the manner in which the traffic management system 1 operates for changing a notification ratio of alarm information depending on the distance from a fault occurrence site. When alarm information is sent from a radio unit to following vehicles, the notification ratio of the alarm information to be sent from the radio unit to the vehicles is changed depending on the distance up to a site where a fault is recognized.

For example, if an accident occurs near the radio unit 20-5, then the notification ratio of alarm information is set to a higher value for vehicles traveling near the radio unit 20-4, and set to a lower value for vehicles traveling near the radio units 20-2, 20-1. In this manner, the notification ratio is set to a higher value for vehicles closer to the fault occurrence site and to a lower value for vehicles remoter from the fault occurrence site.

Figure 23:
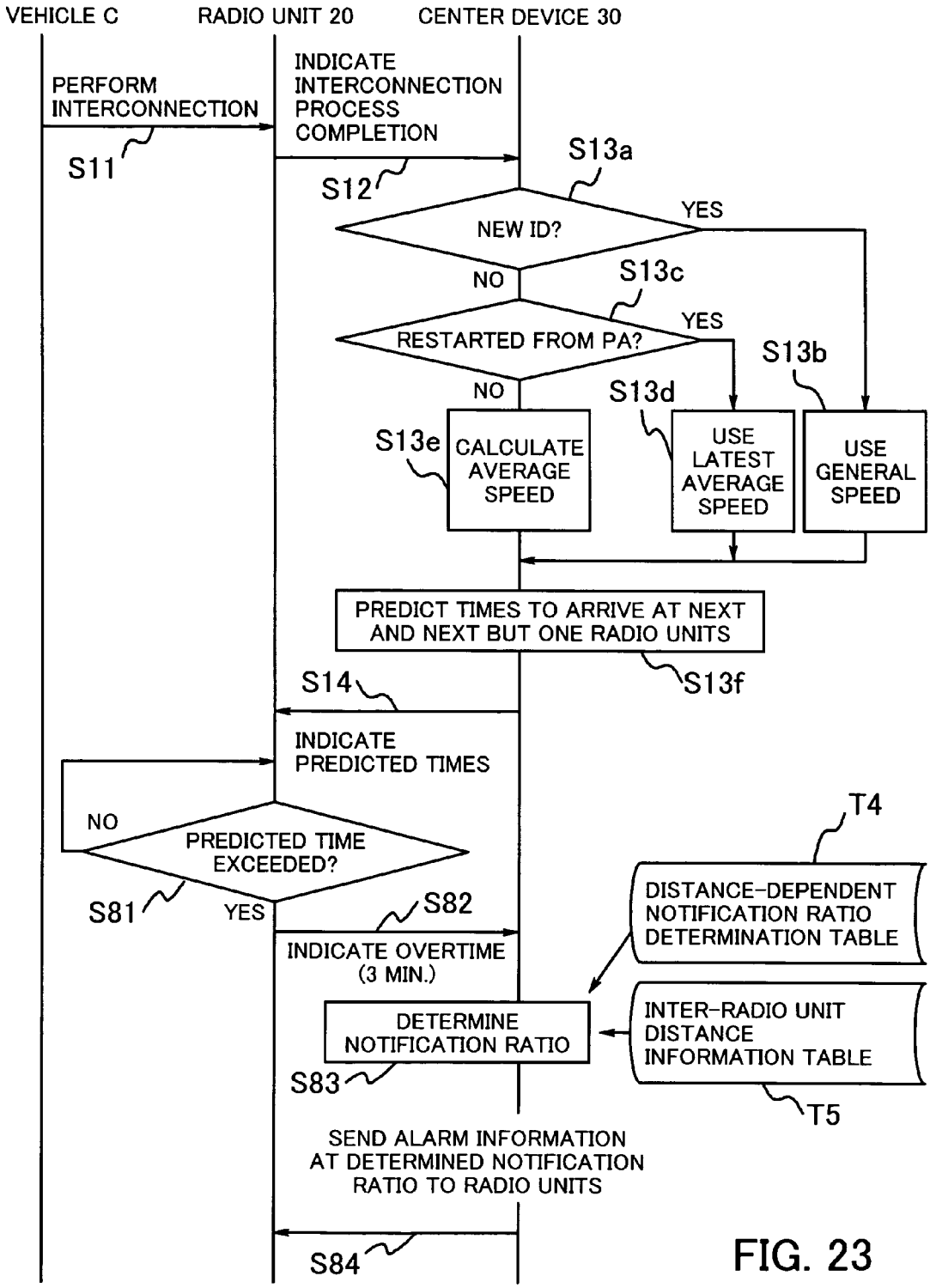
FIG. 23 is a flowchart of an operation sequence of the traffic management system for changing a notification ratio of alarm information depending on the distance from a fault occurrence site.

FIG. 23 shows an operation sequence of the traffic management system 1 for changing a notification ratio of alarm information depending on the distance from a fault occurrence site. Based on information from radio units and distance-dependent notification ratio determination information and inter-radio unit distance information which are registered in the center device 30, the center device 30 instructs the radio units to change the notification ratio of alarm information to be sent from the radio units to following vehicles C. Steps S11 through S14 are identical to those shown in FIG. 6 and will not be described below.

[S81] It is determined whether the predicted time is exceeded or not. If the predicted time is exceeded, then control goes to step S82.

[S82] The overtime is sent. The overtime is 3 minutes.

[S83] A notification ratio of alarm information is determined from the received overtime. A notification ratio of alarm information is determined using a distance-dependent notification ratio determination table T4 and an inter-radio unit distance information table T5 which are stored in the data registration unit 31*e* shown in FIG. 4. FIG. 24 shows the distance-dependent notification ratio determination table T4 and the inter-radio unit distance information table T5.

The distance-dependent notification ratio determination table T4 is a table containing distances from fault occurrence sites and notification ratios in combination. In FIG. 24, if the distance from the fault occurrence site is less than 1 km, then the notification ratio is set to 100%, if the distance from the fault occurrence site is less than 5 km, then the notification ratio is set to 50%, and if the distance from the fault occurrence site is more than 5 km, then the notification ratio is set to 10%.

The inter-radio unit distance information table T5 is a table of distances between radio units. In FIG. 24, the distance between the radio units 20-4, 20-3 is 1 km, the distance between the radio units 20-3, 20-2 is 3 km, and the distance between the radio units 20-2, 20-1 is 4 km.

[S84] Alarm information is sent to vehicles traveling between the radio units 20-4, 20-3 at a notification ratio of 100%, alarm information is sent to vehicles traveling between the radio units 20-3, 20-2 at a notification ratio of 50%, and information is sent to vehicles traveling between the radio units 20-2, 20-1 at a notification ratio of 10%.

Operation of the traffic management system 1 for managing a shuttle bus service will be described below. Radio units are installed at respective bus stops, and the center device 30 manages a bus service based on interconnection process completion information sent from the radio units.

Figure 25:
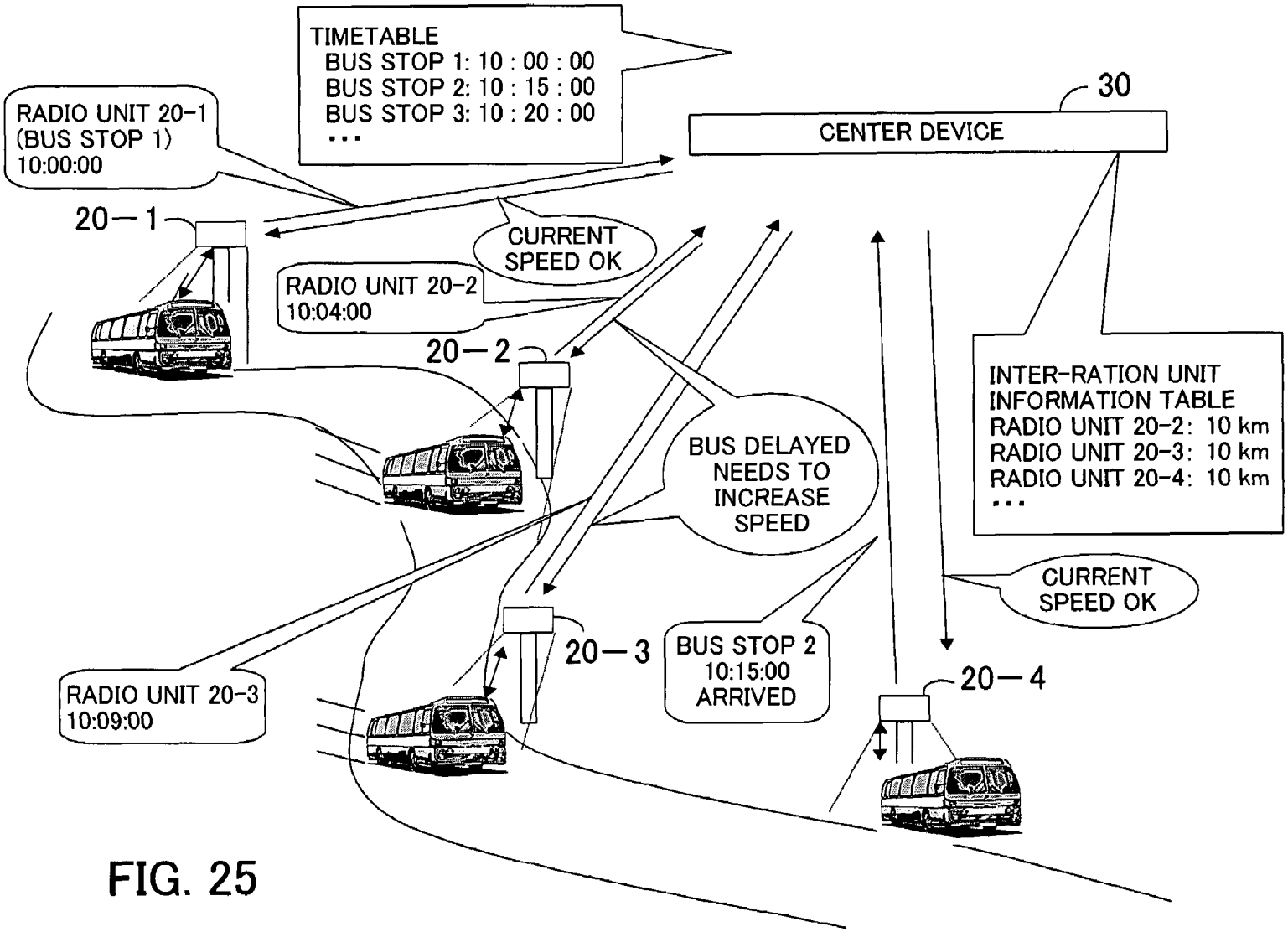
FIG. 25 is a view showing the manner in which the traffic management system operates for managing a shuttle bus service.

FIG. 25 shows the manner in which the traffic management system 1 operates for managing a shuttle bus service. If the present invention is applied to a vehicle operating service such as a shuttle bus service wherein arrival times at respective sites are scheduled in advance, then since a vehicle speed calculated by a radio unit, the distance up to a stop to be reached next, and the time at which the vehicle has to reach the stop are found, the center device 30 can determine whether the vehicle can reach the stop at the planned time or not based on the calculated speed. If the center device 30 judges that the vehicle cannot reach the stop at the planned time, then the center device 30 can instruct the vehicle C to increase its speed.

For example, when an interconnection process completion time of a bus which has completed its connection to the radio unit 20-1 is 10:00:00 and the speed of the bus is calculated as 80 km/h, then if the distance up to a next bus top (the radio unit 20-4) is 30 km and the planned arrival time is 10:15:00, then since the bus cannot make the planned arrival time by traveling at the present speed, the center device 30 instructs the bus to travel at a speed high enough to get to the next stop on time. The instructed bus travels at the instructed speed to travel on schedule.

Figure 26:
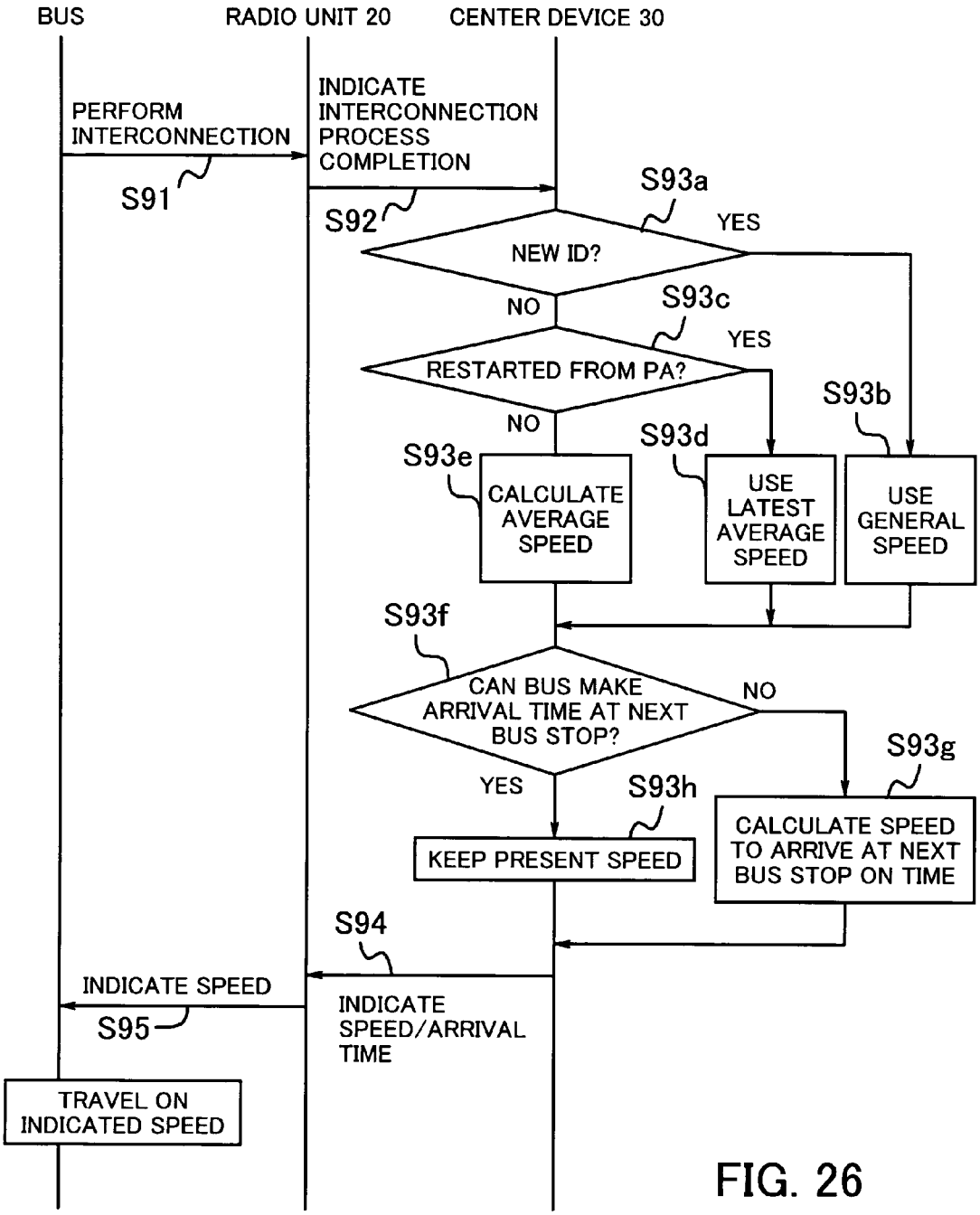
FIG. 26 is a flowchart of an operation sequence of the traffic management system for managing a shuttle bus service.

FIG. 26 shows an operation sequence of the traffic management system 1 for managing a shuttle bus service. The center device 30 can manage a shuttle bus service and instruct buses to travel based on a bus service management table and inter-radio unit distance information stored in the center device 30.

[S91] The bus and the radio unit 20 connect to each other.

[S92] The radio unit 20 notifies the center device 30 of the completion of the interconnection process.

[S93*a*] The center device 30 determines whether the ID of the bus is a new ID or not. If the ID of the bus is a new ID, then control goes to step S93*b*. If not, then control goes to step 93*c*.

[S93*b*] The center device 30 regards the bus as traveling at a general speed and sets the speed.

[S93*c*] The center device 30 determines whether the bus is restarted from a PA. If the bus is restarted from a PA, then control goes to step S93*d*. If not, then control goes to step S93*e*.

[S93*d*] The center device 30 regards the bus as traveling at a latest average speed, and sets the latest average speed.

[S93*e*] The center device 30 calculates the average speed of the bus.

[S93*f*] The center device 30 determines whether the bus can make an arrival time for a next bus stop (the data registration unit 31*e* shown in FIG. 4 registers a time table of bus stops). If the bus can make the arrival time, then control goes to step S93*h*. If not, then control goes to S93*g*.

[S93*g*] The center device 30 calculates a speed to reach the next stop on time.

[S93*h*] The center device 30 keeps the present speed.

[S94] The center device 30 sends the speed and the arrival time for the next bus stop.

[S95] The center device 30 indicates the speed. The bus travels at the indicated speed. Subsequently, the above process from step S91 is repeated.

Operation of the traffic management system 1 for searching for a route when a vehicle is stolen will be described below. If a vehicle equipped with a vehicle-mounted unit 10 is stolen, the center device 30 determines the direction in which the stolen vehicle is traveling from information from the radio units 20 to search for the stolen vehicle.

Figure 27:
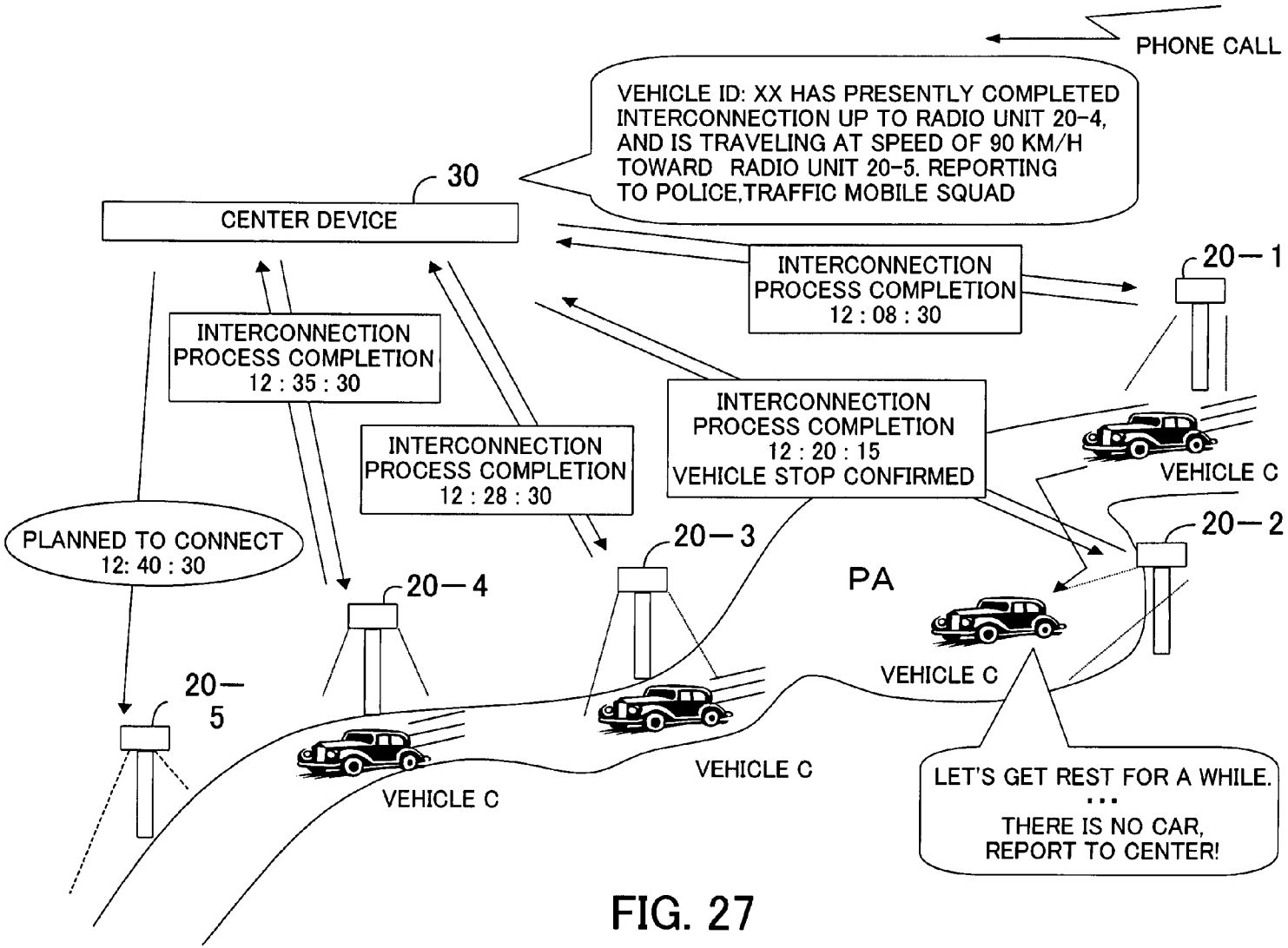
FIG. 27 is a view showing the manner in which the traffic management system operates for searching for a route when a vehicle is stolen.

FIG. 27 shows the manner in which the traffic management system 1 operates for searching for a route when a vehicle is stolen. If a vehicle C parked in a PA is stolen, then providing the radio units connect to the vehicle C, the route of the vehicle C and the speed thereof are readily determined from the locations of the radio units which have connected to the vehicle C and the times at which the radio units have connected to the vehicle C, making it possible to detect the stolen vehicle C.

For example, when a vehicle C is stolen while at rest, the owner of the vehicle C becomes aware of the theft and makes a phone call to the center device 30. The center device 30 can immediately recognize the general present position of the vehicle C based on information from the radio units which have subsequently connected to the vehicle C. By sending the acquired information to a traffic mobile squad or a police department, the stolen vehicle C can quickly be detected and a countermeasure at the time of the theft can easily be taken.

Figure 28:
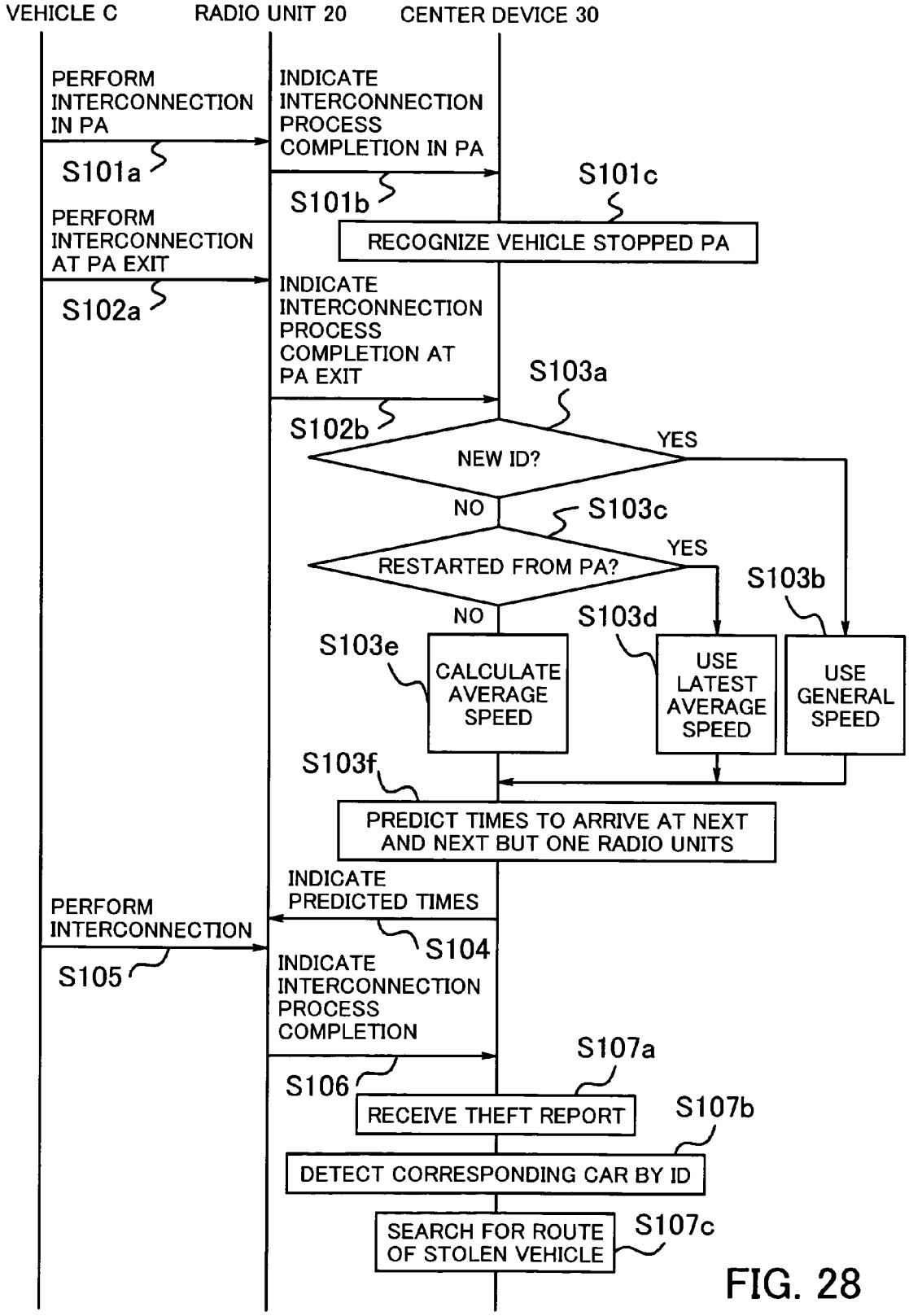
FIG. 28 is a flowchart of an operation sequence of the traffic management system for searching for a route when a vehicle is stolen.
Figure 29:
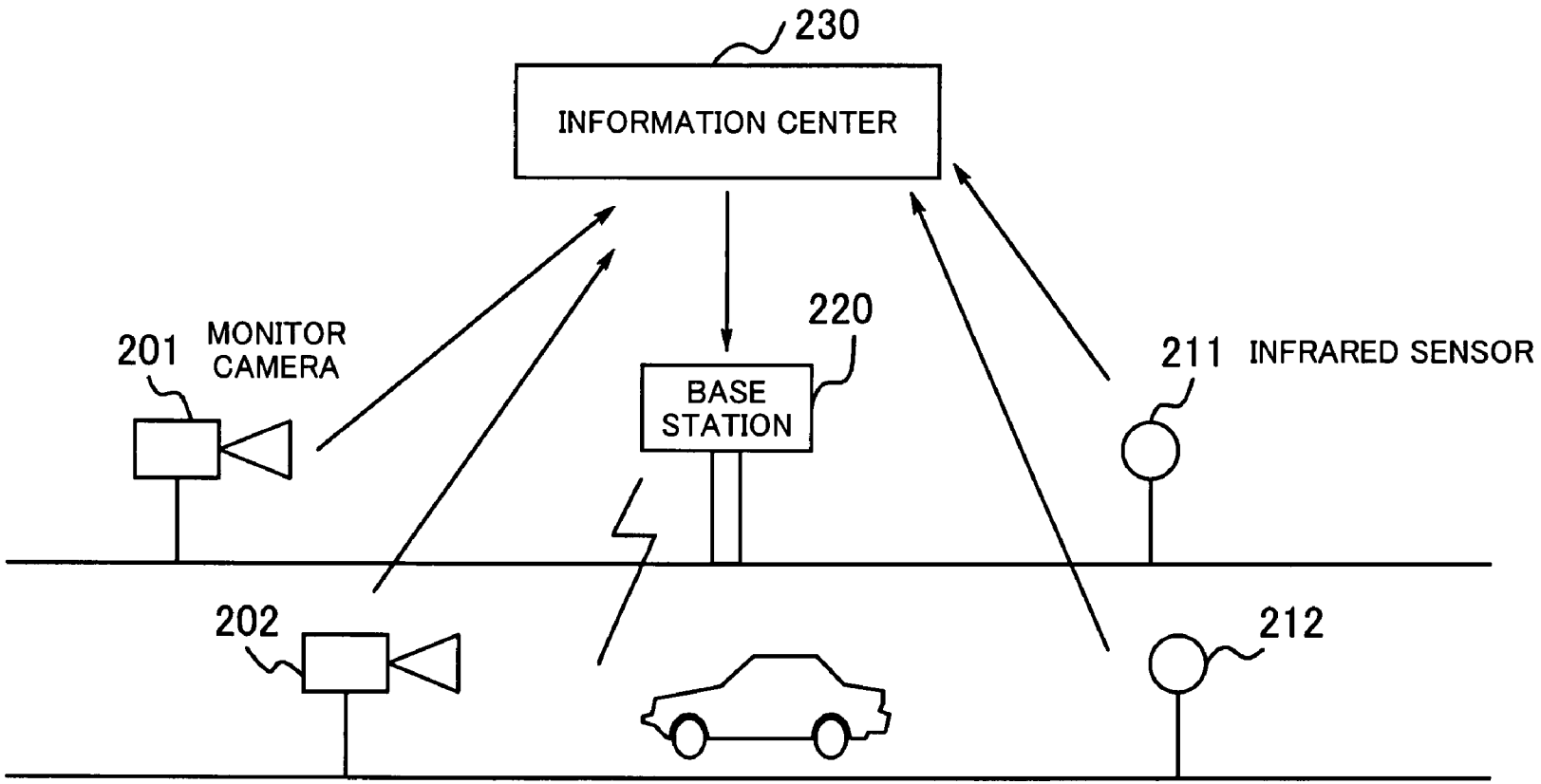
FIG. 29 PRIOR ART
FIG. 29 is a view of a conventional road-to-vehicle short-range radio communication system.

FIG. 28 shows an operation sequence of the traffic management system 1 for searching for a route when a vehicle is stolen.

[S101*a*] The vehicle C and the radio unit 20 in a PA connect to each other.

[S101*b*] The radio unit 20 notifies the center device 30 of the completion of the interconnection process.

[S101*c*] The center device 30 recognizes the vehicle C as being kept at rest in the PA.

[S102*a*] The vehicle C and the radio unit 20 at the exist of the PA connect to each other.

[S102*b*] The radio unit 20 notifies the center device 30 of the completion of the interconnection process.

[S103*a*] The center device 30 determines whether the vehicle ID of the vehicle C is a new ID or not. If the vehicle ID of the vehicle C is a new ID, then control goes to step S103*b*. If not, then control goes to step S103*c*.

[S103*b*] The center device 30 regards the vehicle C as traveling at a general speed and sets the speed.

[S103*c*] The center device 30 determines whether the vehicle C is restarted from a PA or not. If the vehicle C is restarted from a PA, then control goes to step S103*d*. If not, then control goes to step S103*e*.

[S103*d*] The center device 30 regards the vehicle C as traveling at a latest average speed, and sets the latest average speed.

[S103*e*] The center device 30 calculates the average speed of the vehicle C.

[S103*f*] The center device 30 predicts the arrival times of the vehicle C at a next radio unit and a next but one radio unit.

[S104] The center device 30 notifies the corresponding radio units of the predicted times.

[S105] The vehicle C and the radio unit connect to each other.

[S106] The radio unit notifies the center device 30 of the completion of the interconnection process.

[S107*a*] The center device 30 receives a theft report.

[S107*b*] The center device 30 searches for a vehicle based on the vehicle ID.

[S107*c*] The center device 30 acquires information such as the vehicle ID: xx, the interconnection process completion point: the radio unit 20-4, the speed: 90 km, and the traveling direction: the radio unit 20-5, and searches for the route of the stolen vehicle.

According to the present invention, as described above, when a vehicle travels through a radio-wave zone provided by a radio unit installed alongside of a road, a vehicle-mounted unit on the vehicle and the radio unit communicate with each other for user authentication, and times at which the vehicle will complete its connection to successive radio units are predicted, so that a failure of the vehicle and the traveling direction of the vehicle can be managed in real-time.

If the road is divided into a plurality of branches at an expressway junction, for example, and radio units are installed before the junction and at the entrances of the branches, then the traveling direction of the vehicle can be managed by determining which radio unit the vehicle will connect to the next time.

If radio units are installed before the entrances of a PA and an SA (service area) of an expressway, within the PA and the SA, and at the exits of the PA and the SA, then it is possible to determine whether the vehicle has entered the PA or the SA or not by finding which radio unit the vehicle has connected to the next time after having passed across the radio unit before the entrance of the PA or the SA. A vehicle that has entered the PA is managed based on the ID of the vehicle-mounted unit on the vehicle. Therefore, the state of a parking space in the PA or the SA can be managed with respect to vehicle types (light automobiles, ordinary-size automobiles, large-size automobiles, etc.), and can be sent to vehicles before entering the PA or the SA.

Since traveling times of vehicles can be managed, the time management of a shuttle bus, for example, which is managed for its service based on times can be performed in real-time because the speeds of the shuttle bus at respective radio units and a traffic jam ahead of the shuttle bus are known in advance. When a vehicle is stolen, the center device which is notified of the theft report can easily determine the traveling route of the stolen vehicle for quickly solving the problem.

With the traffic management system according to the present invention, a vehicle-mounted unit performs an interconnection process for user authentication when it enters a radio-wave zone provided by a radio unit installed alongside of the road. When the interconnection process is completed, the radio unit sends interconnection process completion information to the center device. If the vehicle does not connect to the radio unit after elapse of a predicted time at which the vehicle is expected to pass across the radio unit, then the radio unit sends an overtime to the center device. If the center device receives the interconnection process completion information, it calculates a predicted time at which the vehicle passes across a radio unit, and sends the predicted time to the radio unit. If the center device receives the overtime and determines the occurrence of a fault, then the center device sends alarm information to those vehicles which are traveling in a region near the site where the fault has occurred. In this manner, the site where the fault, such as an accident or a vehicle failure, has occurred can be detected, and fault information can efficiently be sent to traveling vehicles. Consequently, various traveling states of vehicles can be managed, distributed, and controlled at a high quality level.

The foregoing is considered as illustrative only of the principles of the present invention. Further, since numerous modification and changes will readily occur to those skilled in the art, it is not desired to limit the invention to the exact construction and applications shown and described, and accordingly, all suitable modifications and equivalents may be regarded as falling within the scope of the invention in the appended claims and their equivalents.

What is claimed is:

1. A traffic management system for managing vehicle traffic, comprising:

a vehicle-mounted unit having a vehicle-mounted communication unit having a function to communicate with a center device, for performing an interconnection process for user authentication when entering a predetermined radio-wave zone, using an individual vehicle ID assigned to each vehicle, and sending fault information in the event of a fault occurring on the vehicle;

a radio unit disposed on a road and having a radio communication unit having a function to provide the radio-wave zone for the vehicle and to relay communications between the center device and the vehicle-mounted unit, for sending interconnection process completion information to the center device when the interconnection process for connection to the vehicle is completed, receiving a predicted time at which the vehicle is expected to travel across the radio unit, and sending an overtime to the center device if the vehicle does not connect to the radio unit after elapse of the predicted time; and a center device having a traffic information manager for, when the interconnection process completion information is received, calculating the speed of the vehicle from an inter-radio unit distance and an interconnection time at which the vehicle connects to the radio unit, calculating a predicted time at which the vehicle is expected to pass across a next radio unit from the speed of the vehicle and the distance up to the next radio unit, and sending the predicted time to the radio unit, for, when the fault information is received, sending traffic information including alarm information through the radio unit to vehicles traveling near a site where the fault has occurred on the vehicle, for, when the overtime is received, determining whether the fault has occurred or not, and for, when it is judged that the fault has occurred, sending traffic information including alarm information through the radio unit to vehicles traveling near a site where the fault has occurred on the vehicle.

2. The traffic management system according to claim 1, wherein said radio unit includes a radio unit disposed before a road junction and a radio unit disposed after the road junction, and said center device determines a route of the vehicle based on whether the interconnection process completion information is received from the radio unit disposed before the road junction or the radio unit disposed after the road junction, and, if no interconnection process completion information is received from the radio unit disposed before the road junction or the radio unit disposed after the road junction, but receives an overtime therefrom, judges that a fault has occurred on the vehicle near the road junction and sends alarm information to vehicles traveling near the road junction.

3. The traffic management system according to claim 1, wherein said radio unit includes radio units disposed at the entrance and exit of a parking area and within the parking area, and said center device manages whether the vehicle which has connected to the radio unit at the entrance of the parking area has entered the parking area or has passed by the parking area without entering the parking area based on which radio unit the vehicle connects to, and sends traffic information including parking information to following vehicles based on information sent from the radio unit disposed in the parking area.

4. The traffic management system according to claim 1, wherein said radio unit includes radio units disposed at the entrance and exit of a parking area, and if said center device receives interconnection process completion information from the radio unit disposed at the entrance of the parking area and does not receive interconnection process completion information from the radio unit disposed at the exit of the parking area, but receives an overtime therefrom, judges that a fault has occurred on the vehicle near the parking area and sends alarm information to vehicles traveling near the parking area.

5. The traffic management system according to claim 1, wherein said center device recognizes a risk level of the fault and sets the risk level, and changes a notification ratio of alarm information depending on the magnitude of the risk level.

6. The traffic management system according to claim 1, wherein said center device sets a notification ratio of alarm information to a higher value for vehicles traveling near said site where the fault has occurred, and sets a notification ratio of alarm information to a lower value for vehicles traveling remotely from said site where the fault has occurred.

7. The traffic management system according to claim 1, wherein said radio unit is installed at a bus stop, and said center device manages a bus operating service based on interconnection process completion information from the radio unit.

8. The traffic management system according to claim 1, wherein if the vehicle equipped with said vehicle-mounted unit is stolen, said center device determines a direction in which the stolen vehicle travels through said radio unit to search for the stolen vehicle.

9. A radio unit disposed on a road for providing a radio-wave zone for vehicles and relaying communications between a center device and a vehicle-mounted unit, comprising:

a center-side data communication unit for interfacing with the center device for communications therewith;

a vehicle-side data communication unit for interfacing with the vehicle-mounted unit for communications therewith; and a radio communication unit for performing an interconnection process for connection to one or more of the vehicles and sending interconnection process completion information to the center device when the interconnection process is completed, receiving from the center device a predicted time at which each of the one or more vehicles is expected to pass to the radio unit, sending an overtime to the center device for enabling the center device to send traffic information to the one or more vehicles if any of the one or more vehicles do not connect to the radio unit after elapse of the predicted time, receiving from the center device alarm information including a notification ratio thereof, and sending the alarm information to the one or more vehicles at the notification ratio included in the alarm information when the one or more vehicles enter the radio-wave zone.

10. A center device for managing vehicle traffic, comprising:

a data communication unit for performing data communications with a radio unit disposed on a road; and a traffic information manager for, when interconnection process completion information sent from the radio unit is received, calculating the speed of the vehicle from an inter-radio unit distance and an interconnection time at which the vehicle connects to the radio unit, calculating a predicted time at which the vehicle is expected to pass across a next radio unit from the speed of the vehicle and the distance up to the next radio unit, and sending the predicted time to the radio unit, for, when fault information is received, sending traffic information including alarm information through the radio unit to vehicles traveling near a site where the fault has occurred on the vehicle, for, when an overtime is received, determining whether the fault has occurred or not, and for, when it is judged that a fault has occurred, sending traffic information including alarm information through the radio unit to vehicles traveling near a site where the fault has occurred on the vehicle.

11. A traffic management system for managing vehicle traffic, comprising:

a vehicle-mounted unit for sending individual identification information when entering a radio-wave zone;

a plurality of radio units disposed on a road and providing radio-wave zones for vehicles, for receiving and relaying the individual identification information from said vehicle-mounted unit; and a center device for calculating a predicted time at which the vehicle is expected to pass across a next radio unit based on a time at which the individual identification information is received from said vehicle-mounted unit and distances between the radio unit that has received the individual identification information and the radio units disposed before and after said radio unit.

* * * * *